US008059992B2

(12) United States Patent
Yasuda et al.

(10) Patent No.: US 8,059,992 B2
(45) Date of Patent: Nov. 15, 2011

(54) CORONA CHARGER, AND PROCESS CARTRIDGE AND IMAGE FORMING APPARATUS USING SAME

(75) Inventors: Makoto Yasuda, Hiratsuka (JP); Naohiro Toda, Yokohama (JP); Yoshiki Yanagawa, Numazu (JP); Takeshi Orito, Yokohama (JP); Shinji Nohsho, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 568 days.

(21) Appl. No.: 12/331,557

(22) Filed: Dec. 10, 2008

(65) Prior Publication Data

US 2009/0148186 A1 Jun. 11, 2009

(30) Foreign Application Priority Data

Dec. 10, 2007 (JP) ..... 2007-318183
Dec. 10, 2007 (JP) ..... 2007-318197
Dec. 10, 2007 (JP) ..... 2007-318218
Dec. 27, 2007 (JP) ..... 2007-335770
Jul. 10, 2008 (JP) ..... 2008-179754

(51) Int. Cl.
*G03G 15/02* (2006.01)

(52) U.S. Cl. ..... 399/171; 399/170

(58) Field of Classification Search ..... 399/170, 399/171, 311, 115

See application file for complete search history.

(56) References Cited

U.S. PATENT DOCUMENTS 4,585,320 A 4/1986 Altavela et al.
4,585,322 A 4/1986 Reale
4,585,323 A 4/1986 Ewing et al.
4,646,196 A 2/1987 Reale
5,147,751 A * 9/1992 Kojima et al. ..... 430/119.71
5,845,178 A * 12/1998 Hazama et al. ..... 399/170
6,385,414 B1 * 5/2002 Sato et al. ..... 399/98
7,314,693 B2 1/2008 Ikegami et al.
7,416,823 B2 8/2008 Yanagawa et al.
7,937,025 B2 * 5/2011 Nohsho et al. ..... 399/171
2004/0053149 A1 3/2004 Toda et al.
2005/0169660 A1 8/2005 Yamada et al.
2005/0221210 A1 10/2005 Suzuki et al.
2005/0266325 A1 12/2005 Yanagawa et al.
2005/0282075 A1 12/2005 Ikuno et al.
2005/0287452 A1 12/2005 Tamura et al.
2006/0134540 A1 6/2006 Kondo et al.
2006/0240346 A1 10/2006 Toda et al.
2006/0269323 A1 11/2006 Kabata et al.
2007/0009818 A1 1/2007 Yanagawa et al.

(Continued)

FOREIGN PATENT DOCUMENTS

JP 61-144670 7/1986

(Continued)

OTHER PUBLICATIONS

Mar. 25, 2009 European search report in connection with a counterpart European patent application No. 08 25 3955.

*Primary Examiner* — David Gray
*Assistant Examiner* — Rodney Bonnette
(74) *Attorney, Agent, or Firm* — Cooper & Dunham LLP

(57) ABSTRACT

A corona charger including a corona discharge electrode and a control electrode is provided. A layer including a zeolite, a conductive agent, and a binder resin is formed on a surface of the control electrode.

19 Claims, 6 Drawing Sheets

U.S. PATENT DOCUMENTS

| | | | | |
|---|---|---|---|---|
| 2007/0042281 | A1 | 2/2007 | Orito et al. | |
| 2007/0059617 | A1 | 3/2007 | Toda et al. | |
| 2007/0212627 | A1 | 9/2007 | Yanagawa et al. | |
| 2007/0287083 | A1 | 12/2007 | Gondoh et al. | |
| 2007/0297836 | A1 | 12/2007 | Kawasaki et al. | |
| 2008/0038649 | A1 | 2/2008 | Hirose et al. | |
| 2008/0063962 | A1 | 3/2008 | Toshine et al. | |
| 2008/0112742 | A1 | 5/2008 | Nakamori et al. | |
| 2008/0113285 | A1 | 5/2008 | Nakamori et al. | |
| 2008/0219694 | A1* | 9/2008 | Nakamori et al. | 399/92 |
| 2008/0292981 | A1 | 11/2008 | Toda et al. | |
| 2009/0136261 | A1* | 5/2009 | Hayashi et al. | 399/171 |

FOREIGN PATENT DOCUMENTS

| | | |
|---|---|---|
| JP | 61-144671 | 7/1986 |
| JP | 62-89660 | 6/1987 |
| JP | 5-289473 | 11/1993 |
| JP | 8-23715 | 3/1996 |
| JP | 2561917 | 9/1996 |
| JP | 2001-75338 | 3/2001 |
| JP | 2002-278223 | 9/2002 |
| JP | 2003-43894 | 2/2003 |
| JP | 2003-91143 | 3/2003 |
| JP | 2005-227470 | 8/2005 |

* cited by examiner

CORONA CHARGER, AND PROCESS CARTRIDGE AND IMAGE FORMING APPARATUS USING SAME

BACKGROUND OF THE INVENTION

1. Field of the Invention

The present invention relates to a corona charger, and a process cartridge and an image forming apparatus using the corona charger.

2. Discussion of the Related Art

In a typical electrophotographic image forming apparatus, first, a surface of a photoreceptor is evenly charged, and the charged surface is then exposed to a light beam modulated by image information to form an electrostatic latent image thereon. A toner is supplied to the electrostatic latent image to form a toner image on the surface of the photoreceptor. The toner image is transferred onto a recording medium directly or via an intermediate transfer member, and then fixed thereon upon application of heat and pressure. Residual toner particles remaining on the surface of the photoreceptor are removed by a cleaning blade.

The photoreceptor is typically charged using a corona charger.

Corona discharge is a continuous discharge phenomenon that occurs upon local dielectric breakdown of air in an uneven electric field. A typical corona charger has a configuration in which a corona wire with a micro-diameter is stretched taut in a shield case made of aluminum, a part of which is eliminated. Corona ions are discharged from the part of the sealed case which is eliminated. As the voltage applied to the corona wire increases, a strong electric field is locally formed at the periphery of the corona wire, causing local dielectric breakdown of air and thus continuous discharge of electricity.

The type of corona discharge largely depends on the polarity of the voltage applied to the corona wire. A positive corona discharge causes an even electric discharge on the surface of the corona wire, whereas a negative corona discharge causes a local streamer discharge. Accordingly, the positive corona discharge has an advantage over the negative corona discharge in evenness of electric discharge. In addition, the negative corona discharge produces several tens of times the amount of ozone produced by the positive corona discharge, thereby increasing environmental load.

FIG. 1A is a schematic view illustrating a related-art corotron corona charger. A charging wire, which serves as a corona discharge electrode, with a diameter of 50 to 100 μm and made of tungsten, is shielded with a metal case forming a gap of about 1 cm there between. A high voltage of 5 to 10 kV is applied to the wire, while an opening is disposed facing a charging target. Thus, positive or negative ions are moved to a surface of the charging target, resulting in charging of the charging target.

FIG. 2A is a graph showing a relation between the charging time and the surface potential of a charging target with respect to the related-art corotron corona charger. It is apparent from FIG. 2A that the corotron corona charger continuously charges the charging target, in other words, continuously discharges electricity. Therefore, the corotron corona charger is not always suitable for charging a charging target to a predetermined potential, whereas it is suitable for constantly charging a charging target. For example, the corotron corona charger is suitable for a transfer charger that continuously charges a recording medium.

FIG. 1B is a schematic view illustrating a related-art scorotron corona charger. The scorotron corona charger was developed for the purpose of reducing unevenness in the resultant potential of a charging target. As illustrated in FIG. 1B, the scorotron charger has a configuration in which a plurality of wires or a mesh is provided as a control electrode in an opening of the metal shield case. The opening is disposed facing a charging target, and a bias voltage is applied to the control electrode.

FIG. 2B is a graph showing a relation between the charging time and the surface potential of a charging target with respect to the related-art scorotron corona charger. It is apparent from FIG. 2B that the surface potential of the charging target is saturated at a predetermined charging time. This is because a voltage applied to the control electrode controls the surface potential of the charging target. The saturation value depends on the voltage applied to the control electrode.

Although having a more complicated configuration and providing a lower charging efficiency than the corotron corona charger, the scorotron corona charger is widely used because of having an advantage in evenness of charging. The control electrode is usually known and described as "charging grid" in electrophotographic image forming apparatuses, and therefore the control electrode may be hereinafter referred to as "charging grid".

However, the corona charger has the following problems 1) to 3) which are caused by discharge products such as nitrogen oxides (NOx).

1) Environmental Impact

It is known that a negative corona charger typically produces discharge products because substances in the air are reacted upon a negative corona discharge. Specific examples of the discharge products include ozone ($O_3$) and nitrogen oxides (NOx) such as nitrogen monoxide (NO) and nitrogen dioxide ($NO_2$) that are produced by oxidation of nitrogen with ozone. In general, ozone adversely affects the human respiratory system, and humans can generally sense a foul odor of ozone when it is in concentrations of 0.1 ppm or more. Specifically, nitrogen dioxide ($NO_2$) is the worst at adversely affecting the human respiratory system. A permissible level of nitrogen dioxide ($NO_2$) is 0.04 to 0.06 ppm or less per hour on daily average based on environmental standards. Further, nitrogen oxides may be altered into photochemical oxidants (Ox) by a photochemical reaction caused by ultraviolet rays, a permissible level of which is 0.06 ppm or less based on environmental standards. Generally, several tens of ppm of ozone and several ppm of nitrogen oxides are produced in the corona discharge. Consequently, contemporary image forming apparatuses are provided with a filter made of activated carbon or the like so that fewer discharge products are emitted from the image forming apparatus.

2) Impact on Image Quality 2-1) Unevenness in Image Density Immediately Below Corona Charger During a long-term discharge, discharge products are accumulated on inner walls of a corona charger. When the corona charger is left at rest after the long-term discharge, the discharge products gradually contaminate a charging target, i.e., a photoreceptor, resulting in a difference in surface potential between a surface area of the photoreceptor disposed immediately below the corona charger and the other areas thereof. As a consequence, the resultant image density is uneven. The above-described phenomenon that causes unevenness in the resultant image density prominently occurs in a low-humidity condition of about 20% RH, and rarely occurs at normal temperature and humidity.

Specifically, the surface of the photoreceptor is reversibly reacted with the discharge products, thereby increasing the capacitance or decreasing the resistance of the photoreceptor.

As a result, a difference in surface potential is generated. Most photoreceptors cause this phenomenon. In particular, a photoreceptor having a cross-linked surface layer as a protective layer prominently causes the phenomenon.

FIG. 3A is an example of a halftone image of uneven density. FIG. 3B is a graph showing the surface potential of a photoreceptor corresponding to the halftone image illustrated in FIG. 3A. It is apparent from FIGS. 3A and 3B that areas of the halftone image corresponding to the surface areas of the photoreceptor disposed immediately below the corona charger have a higher image density than the other areas.

2-2) Image Blurring

As long as a photoreceptor is charged by electric discharge in an electrophotographic image forming apparatus, image blurring is caused to a greater or lesser extent, resulting in deterioration of resolution of the resultant image, referred to here as image blurring.

Image blurring is caused by adhesion of paper powder to a photoreceptor and by use environment, and is mainly caused by discharge products. Image blurring cannot be completely prevented unless a photoreceptor is charged by a charging method which does not produce ozone and NOx, which is not yet invented. Image blurring can be suppressed to some extent by heating a photoreceptor, however, problems of shortening of the life of the photoreceptor, waste of electric power, upsizing of apparatus and so forth may arise. Alternatively, image blurring can be suppressed to some extent by abrading a surface of a photoreceptor so that discharge products adhered to the surface can be removed. However, contemporary photoreceptors have developed to have a durable surface that is hard to abrade, resulting in insufficient removal of discharge products.

Discharge products adhere to a photoreceptor sparsely at first, but gradually spread thereover. As a consequence, a hygroscopic, low-resistance layer is formed thereon. As described above, image blurring is a phenomenon in which an image, in particular edges thereof, is blurred because an electrostatic latent image is not normally formed. This phenomenon generally occurs when charges diffuse at a surface of the photoreceptor or the periphery thereof. In a case in which a hygroscopic low-resistance layer is formed on or inside the photoreceptor, charges are diffused, resulting in destabilization of the electrostatic latent image. FIG. 4 is a graph showing the surface potential of a photoreceptor when image blurring occurs.

When a surface of a photoreceptor is negatively charged and subsequently exposed to a light beam containing image information, a pair of a hole and an electron is formed in a charge generation layer. The electron then migrates to a conductive substrate, while the hole migrates toward negative charges present on an outermost layer. If the hole meets a low-resistance layer on the way to the outermost layer, the hole may leak laterally without reaching the outermost layer. If the outermost layer itself has a low resistance, the hole may leak laterally on the outermost layer. In these cases, a normal electrostatic latent image cannot be formed because charges, i.e., holes in these cases, are diffused or dissipated.

The lowness of the resistance of the low-resistance layer is preferably as small as possible for the purpose of suppressing diffusion of charges, that is, deterioration of resolution of the resultant image. When the resistance of the low-resistance layer is very low, in particular, when the volume resistivity is $10^{12}$ Ω·cm or less, the resolution of the resultant image deteriorates, causing image blurring. Finally, a normal image cannot be produced. At that time, the surface potential of the photoreceptor has a dull pattern, not a square wave pattern, as illustrated in FIG. 4. More specifically, a surface potential of a non-image portion is reduced and that of an image portion is increased, showing a low contrast there between. Such an undesirable phenomenon is further aggravated by time and humidity. In order to produce high resolution images, a photoreceptor is required to have a volume resistivity of $10^{13}$ Ω·cm or more and a surface resistivity of $10^{15}$ Ω·cm or more.

2-3) Raindrop-Like Marks

An image forming apparatus using the scorotron corona charger sometimes produces an uneven image with raindrop-like marks as illustrated in FIG. 5. Thin lines in a halftone image illustrated in FIG. 5 are raindrop-like marks. This phenomenon occurs when the charge amount is uneven within a small area of a surface of a photoreceptor. Specifically, when high-resistance substances such as toner, silica that is an external additive of the toner, or discharge products are adhered to a charging wire, electric discharge does not occur reliably, causing the above-described phenomenon. When the high-resistance substances described above are adhered to a charging grid, discharged charges cannot flow into the charging grid and flow into the photoreceptor instead, causing the above-described phenomenon. Alternatively, the charging grid itself is charged because the capacitance thereof is increased, thereby excessively charging the photoreceptor locally.

3) Problem in Retaining of Adsorbent

As described above, in order to reduce the emission amount of discharge products from an image forming apparatus, a filter may be provided on an emission path. A charging target disposed immediately below the corona charger is generally contaminated with discharge products, while the corona charger and the charging target are generally disposed facing with each other forming a gap of 1 to 2 mm there between so that the charging target is reliably charged. In order to prevent contamination of the charging target with discharge products, a complicated mechanism is required such that a shield is disposed between the corona charger and the charging target, or the corona charger or the charging target is withdrawn after the electric discharge.

To overcome the disadvantages of such a complicated configuration, one proposed approach involves retaining a zeolite on the charging grid for the purpose of preventing contamination of the charging target with discharge products without such a mechanism. Specifically, the zeolite retained on the charging grid adsorbs discharge products to prevent contamination of a charging target therewith. The charging grid typically retains the zeolite using a binder resin.

However, the zeolite retained on the charging grid may be released therefrom with time, resulting in insufficient removal of discharge products. This is because the discharge products, that is, reactive gases such as ozone and nitrogen oxides may degrade the binder resin with time.

In attempting to solve such problems, Unexamined Japanese Patent Application Publication No. (herein after "JP-A") 2005-227470 discloses a corona charger, the charging grid of which is made of SUS and coated with a conductive coating composition including an organic binder resin and fine particles of graphite, nickel, and an aluminum-compound. It is disclosed therein that such a configuration prevents corrosion of the charging grid because the conductive coating layer adsorbs discharge products. Accordingly, a charging target is prevented from being contaminated with discharge products. However, since the fine particles in the conductive coating layer adsorb discharge products, the capacity for adsorbing discharge products depends on the number of adsorbing sites in the fine particles, and there is a possibility that the adsorbing sites become buried with long-term use.

Unexamined Japanese Utility Model Application Publication No. 62-089660 discloses a corona charger in which finely partitioned communicating holes are arranged within an opening, and an ozone-adsorbing layer containing an ozone-adsorbing material is further formed on the inner surface of the communication holes. A zeolite and an activated carbon are used as the ozone-adsorbing material. It is disclosed therein that such a configuration prevents diffusion of ozone. However, it is difficult to prevent ozone from diffusing toward a charging target side, possibly contaminating a charging target with ozone.

JP-2003-43894-A discloses an image forming apparatus including a corona charger and a means for removing (adsorbing) discharge products adhered to a charging target, and at least one of a means for preventing adhesion of discharge products to the charging target, a means for preventing lowering of the resistance of the discharge products adhered to the charging target, and a means for reducing the amount of discharge products produced at the periphery of the charging target. Accordingly, multiple members are needed, which is a disadvantage. An embodiment is also disclosed therein in which an adsorbent such as a zeolite is provided between the charging target and the corona charger. However, such an embodiment cannot reliably charge the charging target.

In attempting to effectively reduce the amount of discharge products generated at the periphery of a charger, JP-2001-075338-A discloses an image forming apparatus containing a photocatalyst (i.e., a semiconductor such as titanium oxide) on a surface that faces a discharge wire. The photocatalyst effectively decomposes discharge products so as to reduce the amount thereof. However, the decomposition ability of the photocatalyst may not last for an extended period of time.

JP-2002-278223-A discloses an image forming apparatus including a charging member mainly composed of a catalytic and conductive material such as activated carbon fiber for the purpose of preventing deterioration of image quality under high-humidity conditions, improving durability of a photoreceptor, and preventing generation of discharge products such as ozone and nitrogen oxide. However, an ability of the activated carbon fiber to adsorb discharge products may deteriorate with long-term use. Further, an optional coating layer may not be consistently formed on such an activated carbon fiber because adhesion properties there between may deteriorate with long-term use.

JP-2003-091143-A discloses an image forming apparatus in which a corona charger is disposed below a photoreceptor. An adsorptive and catalytic member is provided on a back side of the corona charger so as to adsorb discharge products. However, the discharge products may also diffuse to a photoreceptor side, which is opposite the back side of the corona charger, resulting in incomplete adsorption of the discharge products.

SUMMARY OF THE INVENTION

Accordingly, an object of the present invention is to provide a corona charger that produces fewer discharge products so as not to contaminate either the environment or a charging target.

An other object of the present invention is to provide a process cartridge and an image forming apparatus that reliably produces high quality images.

To achieve such objects, the present invention contemplates the provision of a corona charger, comprising:

a corona discharge electrode; and a control electrode, wherein a layer comprising a zeolite, a conductive agent, and a binder resin is formed on a surface of the control electrode; and a process cartridge and an image forming apparatus using the above corona charger.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1A:
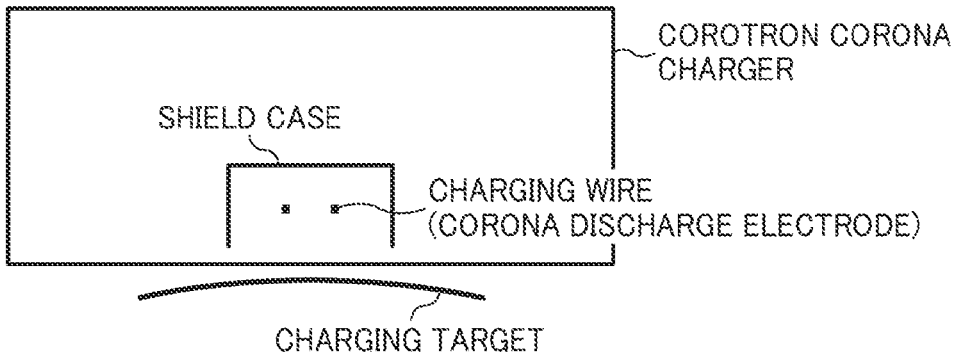
FIG. 1A RELATED ART
FIG. 1A is a schematic view illustrating a related-art corotron corona charger.
Figure 1B:
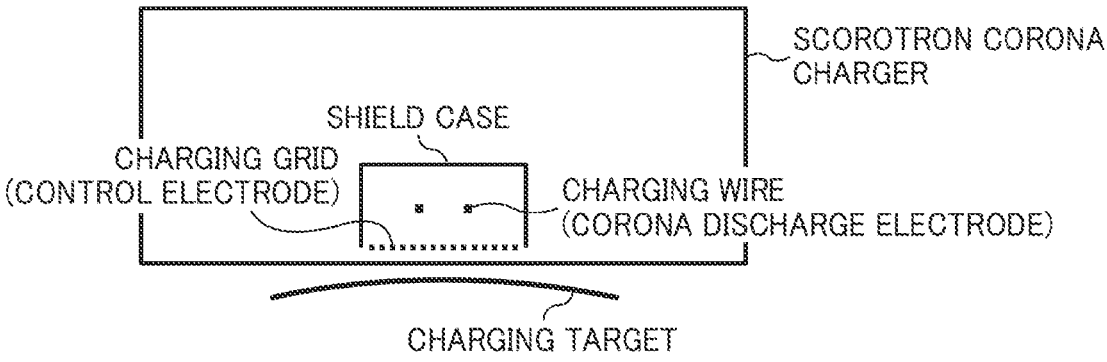
FIG. 1B RELATED ART
FIG. 1B is a schematic view illustrating a related-art scorotron corona charger.
Figure 2A:
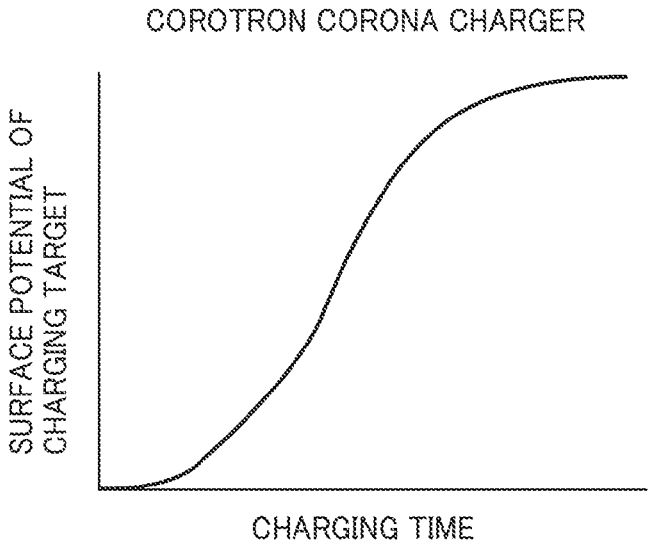
FIG. 2A RELATED ART
FIG. 2A is a graph showing a relation between the charging time and the surface potential of a charging target with respect to the related-art corotron corona charger.
Figure 2B:
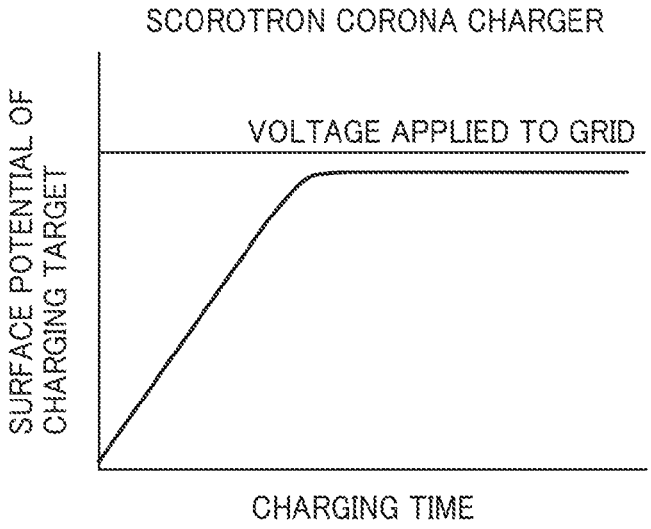
FIG. 2B RELATED ART
FIG. 2B is a graph showing a relation between the charging time and the surface potential of a charging target with respect to the related-art scorotron corona charger.
Figure 3A:
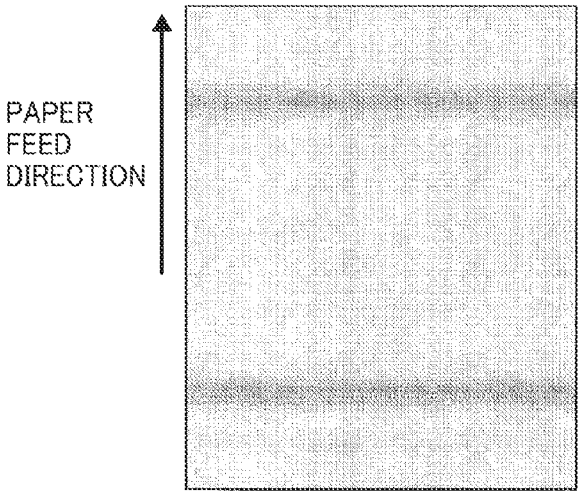
FIG. 3A RELATED ART
FIG. 3A is an example of a halftone image of uneven density.
Figure 3B:
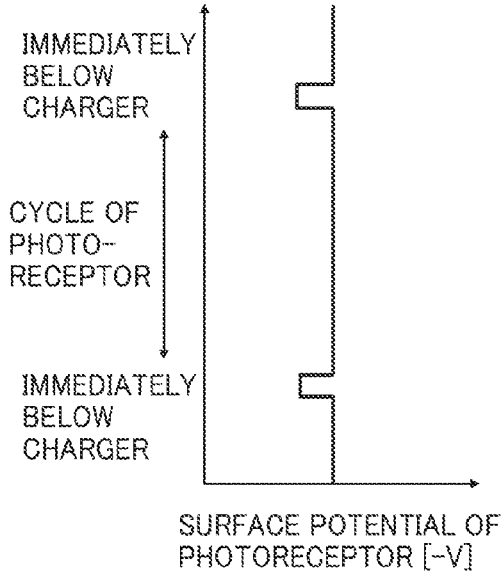
FIG. 3B RELATED ART
FIG. 3B is a graph showing the surface potential of a photoreceptor corresponding to the halftone image illustrated in FIG. 3A.
Figure 4:
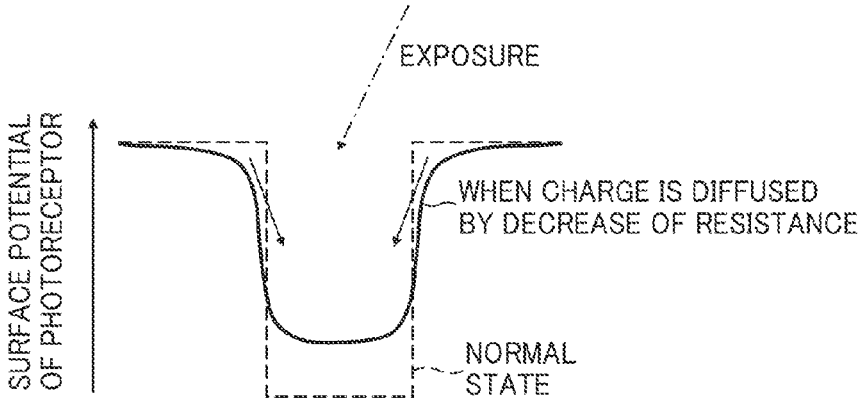
FIG. 4 RELATED ART
FIG. 4 is a graph showing the surface potential of a photoreceptor when image blurring occurs.
Figure 5:
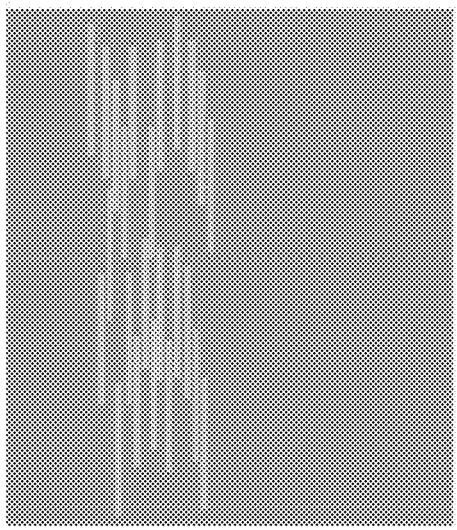
FIG. 5 RELATED ART
FIG. 5 is an example of an uneven image with raindrop-like marks.
Figure 6:
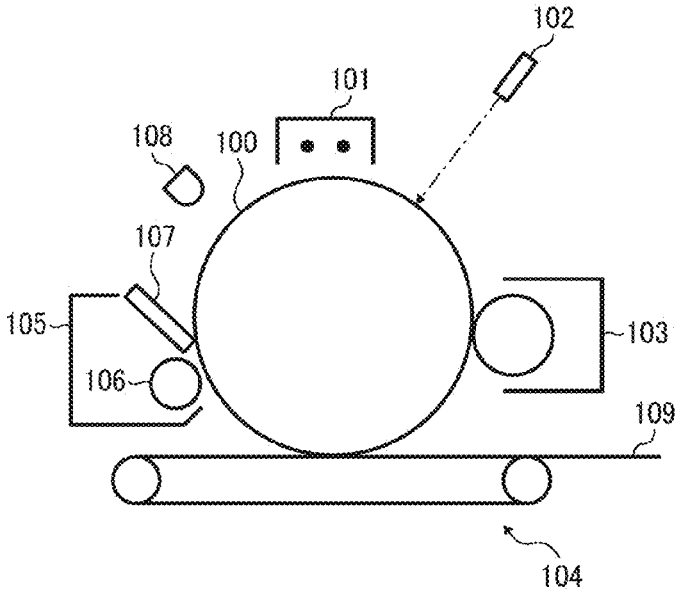
FIG. 6 is a schematic view illustrating an embodiment of an electrophotographic image forming apparatus of the present invention.

FIG. 6 is a schematic view illustrating an embodiment of an electrophotographic image forming apparatus of the present invention. A photoreceptor 100 is charged to a potential of ±600 to 1400 V by a charger 101. The charged photoreceptor 100 is then irradiated with a light beam emitted from a light irradiator 102 so that a latent image is formed thereon. For example, in an analog copier, an original image is irradiated with a light beam emitted from an irradiating lamp, the irradiated image is then reflected by a mirror, and the reflected mirror image is projected onto the photoreceptor. As another example, in a digital copier, an original image is read by a CCD (charge-coupled device) so as to be converted into a digital signal of an LD or LED having a wavelength of 400 to 780 nm, and the digital signal forms an image on the photoreceptor. Accordingly, the wavelength of the light beam for forming a latent image on the photoreceptor varies depending on whether the copier is analog or digital. At a time of the irradiation, charge separation occurs in a photo conductive layer of the photoreceptor, resulting in formation of a latent image.

The latent image formed on the photoreceptor 100 is then developed with a developer in a developing device 103 to form a toner image. The toner image thus formed on the photoreceptor 100 is then transferred onto a recording sheet 109 upon application of a voltage to a transfer device 104. The applied voltage is controlled so that a constant current flows in the photoreceptor 100. On the other hand, residual toner particles that remain on the photoreceptor 100 without being transferred onto the recording sheet 109 during development of the latent image into a toner image are removed by a cleaning device 105. The cleaning device 105 includes a cleaning brush 106 and a cleaning blade 107 made of an elastic rubber. Subsequently, residual latent images that remain on the photoreceptor 100 are removed by a decharging device 108 so that the photoreceptor 100 is prepared for a next image forming operation. Thus, a series of image forming processes is finished.

The above-described image forming members may be directly mounted on an image forming apparatus such as a copier, a facsimile, and a printer. Alternatively, they may be integrally supported as a process cartridge detachably attachable to an image forming apparatus.

For example, such a process cartridge may include a photoreceptor, and at least one member selected from a charger, a developing device, a transfer device, a cleaning device, and a decharging device.

A description is now given of the photoreceptor.

Figure 7A:
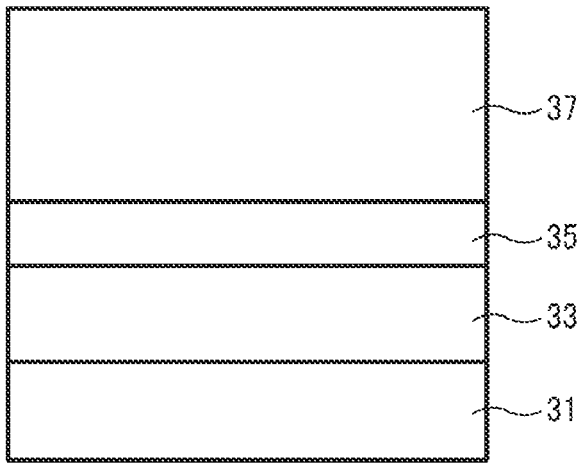
FIG. 7A is a schematic cross-sectional view illustrating an embodiment of a multilayer photoreceptor.
Figure 7B:
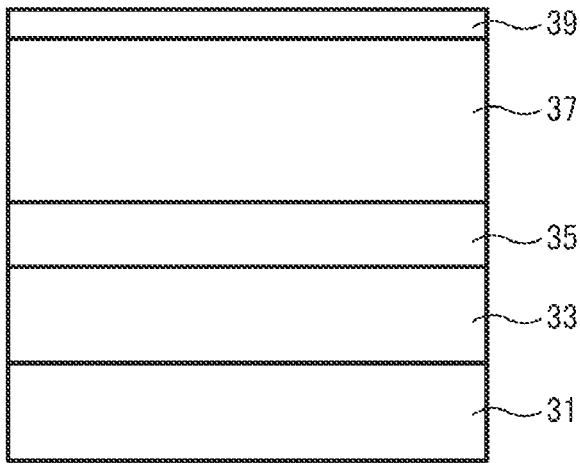
FIG. 7B is a schematic cross-sectional view illustrating another embodiment of a multilayer photoreceptor.

FIG. 7A is a schematic cross-sectional view illustrating an embodiment of a multilayer photoreceptor including, in order from an innermost side thereof, a conductive substrate 31, an intermediate layer 33, a charge generation layer 35, and a charge transport layer 37. FIG. 7B is a schematic cross-sectional view illustrating another embodiment of a multilayer photoreceptor further including a protective layer 39 formed on the charge transport layer 37.

Suitable materials for the conductive substrate 31 include material having a volume resistivity not greater than $10^{10}$ Ω·cm. Specific examples of such materials include, but are not limited to, plastic films, plastic cylinders, or paper sheets, on the surface of which a metal such as aluminum, nickel, chromium, nichrome, copper, gold, silver, platinum, and the like, or a metal oxide such as tin oxides, indium oxides, and the like, is formed by deposition or sputtering. In addition, a metal cylinder can also be used as the conductive substrate 31, which is prepared by tubing a metal such as aluminum, aluminum alloys, nickel, and stainless steel by a method such as a drawing ironing method, an impact ironing method, an extruded ironing method, and an extruded drawing method, and then treating the surface of the tube by cutting, super finishing, polishing, and the like treatments. In addition, an endless nickel belt and an endless stainless can be also used as the conductive substrate 31.

Further, substrates, in which a conductive layer is formed on the above-described conductive substrates by applying a coating liquid including a binder resin and a conductive powder thereto, can be used as the conductive substrate 31.

Specific examples of usable conductive powders include, but are not limited to, carbon black, acetylene black, powders of metals such as aluminum, nickel, iron, nichrome, copper, zinc, and silver, and powders of metal oxides such as conductive tin oxides and ITO. Specific examples of usable binder resins include thermoplastic, thermosetting, and photocrosslinking resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin. Such a conductive layer can be formed by coating a coating liquid in which a conductive powder and a binder resin are dispersed or dissolved in a proper solvent such as tetra hydrofuran, dichloromethane, methyl ethyl ketone, toluene, and the like solvent, and then drying the coated liquid.

In addition, substrates, in which a conductive layer is formed on a surface of a cylindrical substrate using a heat-shrinkable tube which is made of a combination of a resin such as polyvinyl chloride, polypropylene, polyester, polystyrene, polyvinylidene chloride, polyethylene, chlorinated rubber, and TEFLON®, with a conductive powder, can also be used as the conductive substrate 31.

The intermediate layer 33 is optionally provided for the purpose of preventing injection of charge from the conductive substrate 31 and the occurrence of moiré. The intermediate layer 33 includes a binder resin as a main component and optionally includes fine particles. Specific preferred examples of suitable binder resins include, but are not limited to, thermoplastic resins such as polyvinyl alcohol, nitrocellulose, polyamide, and polyvinyl chloride, and thermosetting resins such as polyurethane and alkyd-melamine resin. Specific preferred examples of suitable fine particles include, but are not limited to, fine particles of titanium oxide, aluminum oxide, tin oxide, zinc oxide, zirconium oxide, magnesium oxide, and silica. These particles may be surface-treated. Among these materials, titanium oxide is most preferable from the viewpoint of dispersibility and electric properties. Either rutile-form or anatase-form titanium oxides can be used.

The intermediate layer 33 can be formed by applying a coating liquid on the conductive substrate 31, followed by drying. The coating liquid is prepared by dissolving the binder resin in an organic solvent and further dispersing the fine particles therein using a ball mill or a sand mill. The intermediate layer 33 preferably has a thickness of 10 μm or less, and more preferably from 0.1 to 6 μm.

The charge generation layer 35 includes a charge generation material as a main component and optionally includes a binder resin. Usable charge generation materials include both inorganic and organic charge generation materials.

Specific examples of usable inorganic charge generation materials include, but are not limited to, crystalline selenium, amorphous selenium, selenium-tellurium compounds, selenium-tellurium-halogen compounds, selenium-arsenic compounds, and amorphous silicone. In particular, amorphous-silicone in which dangling bonds are terminated with a hydrogen or halogen atom, and that doped with a boron or phosphorous atom are preferable.

Specific examples of usable organic charge generation materials include, but are not limited to, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having a oxadiazole skeleton, azo pigments having a bisstilbene skeleton, azo pigments having a distyryl oxadiazole skeleton, azo pigments having a distyryl carbazole skeleton, perylene pigments, anthraquinone and polycyclic quinone pigments, quinonimine pigments, diphenylmethane and triphenylmethane pigments, benzoquinone and naphthoquinone pigments, cyanine and azomethine pigments, indigoid pigments, and bisbenzimidazole pigments. These materials can be used alone or in combination.

Specific examples of usable binder resins for the charge generation layer 35 include, but are not limited to, polyamide, polyurethane, epoxy resins, polyketone, polycarbonate, silicone resins, acrylic resins, polyvinyl butyral, polyvinyl formal, polyvinyl ketone, polystyrene, poly-N-vinylcarbazole, and polyacrylamide. These binder resins can be used alone or in combination.

Further, a charge transport polymer that has a function of transporting charge may be also used for the charge generation layer 35. Specific examples of usable charge transport polymers include, but are not limited to, polymers such as polycarbonate, polyester, polyurethane, polyether, polysiloxane, and acrylic resins having an arylamine skeleton, a benzidine skeleton, a hydrazone skeleton, a carbazole skeleton, a stilbene skeleton, or a pyrazoline skeleton; and polymers having a polysilane skeleton.

The charge generation layer 35 may include a low-molecular-weight charge transport material. Usable low-molecular-weight charge generation materials include both electron transport materials and hole transport materials.

Specific examples of suitable electron transport materials include, but are not limited to, electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and diphenoquinone derivatives. These electron transport materials can be used alone or in combination.

Specific examples of suitable hole transport materials include, but are not limited to, electron donating materials such as oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives. These hole transport materials can be used alone or in combination.

The charge generation layer 35 can be formed by a typical method for forming a thin film under vacuum or a typical casting method.

Specific examples of the former method include, but are not limited to, a vacuum deposition method, a glow discharge decomposition method, an ion plating method, a sputtering method, a reactive sputtering method, and a CVD method. The above-described inorganic and organic charge generation materials are preferably used therefor.

In the latter casting method, first, the above-described inorganic or organic charge generation material, optionally together with a binder resin, are dispersed in a solvent such as tetra hydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate, and butyl acetate, using a ball mill, an attritor, a sand mill, or a bead mill. The resultant dispersion of the charge generation material is diluted appropriately to prepare a coating liquid. Further, a leveling agent such as a dimethyl silicone oil and a methylphenyl silicone oil may be optionally included in the coating liquid. The coating liquid is coated on a lower layer by a dip coating method, a spray coating method, a bead coating method, a ring coating method, or the like method.

The charge generation layer 35 thus prepared preferably has a thickness of from 0.01 to 5 μm, and more preferably from 0.05 to 2 μm.

The charge transport layer 37 has a function of transporting charge. The charge generation layer 37 can be formed by, for example, dissolving or dispersing a charge transport material having a function of transporting charge and a binder resin in a solvent, and the resultant solution or dispersion is applied on the charge generation layer 35, followed by drying. Specific examples of suitable charge transport materials for the charge transport layer 37 include the above-described electron transport materials, hole transport materials, and charge transport polymers suitable for the charge generation layer 35.

Specific examples of suitable binder resins for the charge transport layer 37 include, but are not limited to, thermoplastic and thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl chloride, polyvinylidene chloride, polyarylate resin, phenoxy resin, polycarbonate, cellulose acetate resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin.

The content of the charge transport material is preferably from 20 to 300 parts by weight, and more preferably from 40 to 150 parts by weight, based on 100 parts by weight of the binder resin. The charge transport polymer can se used alone or in combination with the binder resin.

Specific examples of suitable solvents for preparing a coating liquid of the charge transport layer 37 include the above-described solvents suitable for that of the charge generation layer 35. Specifically, solvents capable of sufficiently dissolving the charge transport material and the binder resin are preferable. These solvents can be used alone or in combination. The charge transport layer 37 can be formed by the same method as the charge generation layer 35.

The charge transport layer 37 may optionally include a plasticizer and a leveling agent.

Specific examples of suitable plasticizer for the charge transport layer 37 include, but are not limited to, dibutyl phthalate and dioctyl phthalate, which are typically used as plasticizers of resins. The content of the plasticizer is preferably from 0 to 30 parts by weight based on 100 parts by weight of the binder resin.

Specific examples of suitable leveling agents for the charge transport layer 37 include, but are not limited to, silicone oils such as dimethyl silicone oil and methylphenyl silicone oil, and polymers and oligomers having a perfluoroalkyl group as a side chain. The content of the leveling agent is preferably from 0 to 1 part by weight based on 100 parts by weight of the binder resin.

The charge transport layer 37 preferably has a thickness of from 5 to 40 μm, and more preferably from 10 to 30 μm.

The protective layer 39 is provided for the purpose of improving a resistance to abrasion and scratching. Fine particles of conductive materials and/or lubricative materials such as fluorine-containing resins and acrylic resins may be dispersed in the protective layer 39, for example. Alternatively, a layer of a cross-linked resin having a good mechanical strength may be formed as the protective layer 39. Specific examples of suitable cross-linked resins include, but are not limited to, phenol resins, urethane resins, melamine resins, hardened acrylic resins, and siloxane resins. Further, the protective layer 39 preferably includes a charge transport material to improve electric properties thereof. Specific examples of suitable charge transport materials for the protective layer 39 include the above-described charge transport materials suitable for the charge transport layer 37.

A description is now given of the charging grid.

The charging grid of the corona charger is typically made of a metal that is conductive to serve as a control electrode. Specific examples of suitable metals include, but are not limited to, aluminum, nickel, iron, nichrome, copper, zinc, and silver. Since the corona charger is exposed to discharge products such as ozone and nitrogen oxides, metals having high corrosion resistance are preferable, such as stainless steel including chrome and nickel.

In addition, the charging grid has a function of transporting charges produced by the corona discharge to a photoreceptor and serves as a control electrode. Therefore, the charging grid is preferably composed of a thin metal plate on which a grid is formed by punching or etching, or as a plurality of metal wires arranged at even intervals.

Figure 8:
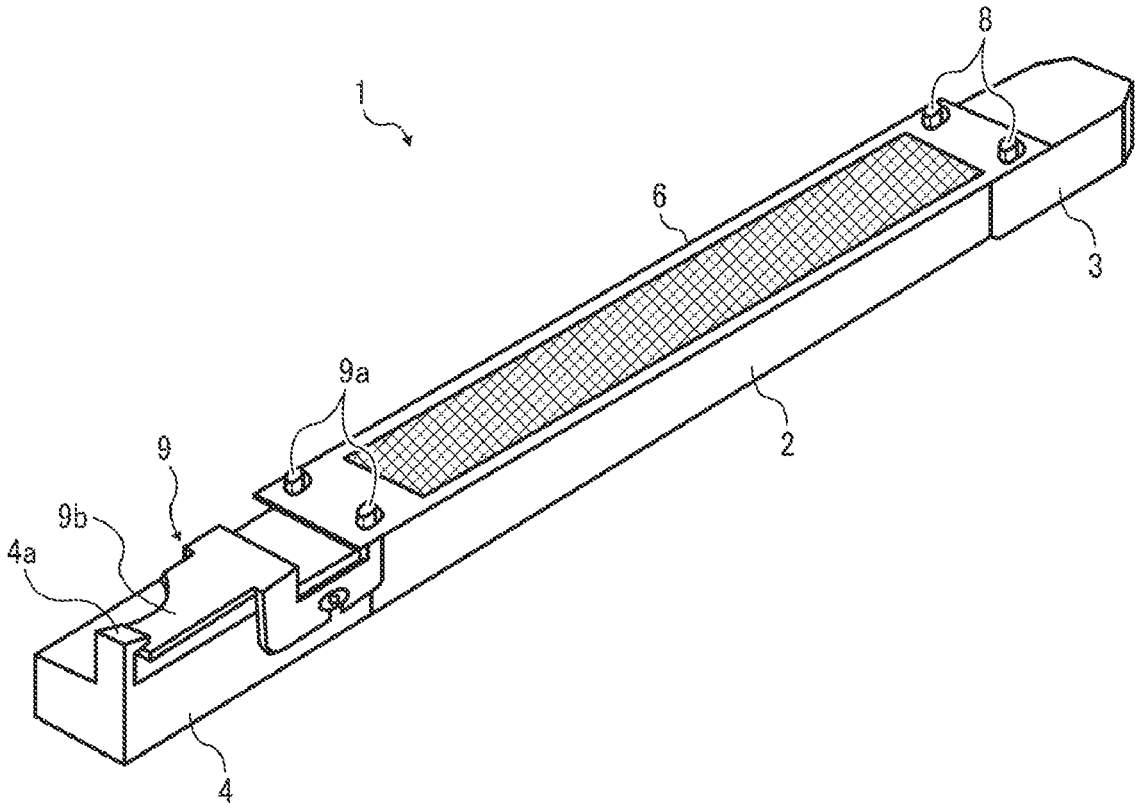
FIG. 8 is a schematic view illustrating an embodiment of a corona charger of the present invention.

FIG. 8 is a schematic view illustrating an embodiment of a corona charger of the present invention. A corona charger 1 includes a casing 2, insulative end blocks 3 and 4, a charging grid 6, claws 8 configured to stretch the charging grid 6 taut, an electrode 9 configured to apply a grid bias, and claws 9*a* configured to stretch the charging grid 6 taut and to provide electrical continuity between the charging grid 6 and the electrode 9.

In the present embodiment, the charging grid 6 is made of a plate of SUS304 having a thickness of 0.1 mm, a length of 285 mm, and a width of 40 mm. A grid pattern, each section having sides of 0.1 mm are formed at an angle of 45° and intervals of 0.5 mm, is formed within an opening having a length of 250 mm and a width of 36 mm.

In the present embodiment, zeolite is used for removing discharge products. Zeolite is a crystal mainly composed of aluminum and silicon. A crystal of zeolite is too small to visually check the shape and size thereof, but which when magnified reveals a lot of fine pores. More than 40 kinds of zeolite have been found in the natural world.

Zeolite has an adsorption ability and a decomposition ability. In order to further improve such properties, synthetic zeolites have been commercially manufactured. Although having high characteristics, a disadvantage of such synthetic zeolites is their high manufacturing cost.

For the above-described reason, zeolites manufactured using recycled materials such as coal ash have received attention recently, as being both useful and environmentally sound. In addition, such zeolites have an advantage of low manufacturing cost.

As described above, zeolite has an ability to adsorb various substances. The mechanism of adsorption is similar to that of a deodorant or a desiccant. Accordingly, zeolite is capable of adsorbing hazardous substances and removing foul odors.

In addition, zeolite has an excellent cation-exchanging capabilities that are two to three times those of natural zeolite. Accordingly, zeolite is capable of ameliorating soil degradation by neutralizing acid and removing ammonium ion from sewage or drainage.

Further, zeolite functions as a catalyst. Accordingly, various attempts have been made to use zeolite for the purpose of decomposing nitrogen oxides (NOx).

The kind of molecule which can be adsorbed in the pores of a zeolite is determined by the size of the pores, and the size of the pores varies depending on the crystal form and the kind of cationic species of the zeolite. Therefore, the crystal form and the kind of cationic species are preferably optimized according to a target material.

Zeolite generally has a crystal form of A form, X form, Y form, L form, mordenite form, ferrierite form, ZSM-5 form, or beta form, and generally includes a cationic species such as potassium, sodium, calcium, ammonium, and hydrogen. In addition, the absorption ability and the function of a catalyst also vary depending on the content ratio between aluminum and silicon in the zeolite.

Among various kinds of zeolites, those having a crystal form of A form, X form, or Y form, and including a cationic species selected from potassium, sodium, and calcium are preferable. Such a zeolite sufficiently removes discharge products even after long-term discharge.

A zeolite is retained on the charging grid using a binder resin. In other words, a layer including a binder resin and a zeolite is formed on the charging grid. Both natural and synthetic resins can be used as the binder resin. Specific examples of suitable synthetic resins include, but are not limited to, thermoplastic and thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin. These resins can be used alone or in combination.

The binder resin is required to be resistant to electric discharge and to be intimately adhered to the charging grid. Accordingly, the amount of a thermosetting resin having a network structure, which is formed by a polymerization upon application of heat, is preferably as small as possible.

Moreover, the binder resin is required not to excessively cover the zeolite to the point of suppressing the ability of zeolite to remove discharge products. Therefore, the layer generally includes the binder resin in an amount of about 10 to 30% by weight. Within such a range, not only can the zeolite sufficiently remove discharge products but the layer can also be intimately adhered to the charging grid.

In addition to the above-described resins, a hardened resin composition including an alkyd resin and an amino resin is preferable for the binder resin because such a resin composition is capable of finely dispersing zeolite and intimately adhering to the charging grid, providing a reliable layer on the charging grid over a long term.

Usable alkyd resins include oil-modified alkyd resins, oil-free alkyd resins, and epoxy-modified alky resins. Specific examples of commercially available oil-modified alkyd resins include, but are not limited to, ETERKYD 3803-X-65 (from Eternal Chemical Co., Ltd.), BECKOSOL EZ-3801-60 (from DIC Corporation), and PHATALKYD 804-701A (from Hitachi Chemical Co., Ltd.). Specific examples of commercially available oil-free alkyd resins include, but are not limited to, BECKOLITE 46-118 and BECKOLITE M-6401-50 (from DIC Corporation), ALMATEX™ P645 (from Mitsui Chemicals, Inc.), and ETERKYD 5062-X-70-1 (from Eternal Chemical Co., Ltd.). Specific examples of commercially available epoxy-modified alkyd resins include, but are not limited to, BECKOSOL P-790-50 (from DIC Corporation), EPOKEY® 701HV, and ETERKYD NP1022-R-50 (from Eternal Chemical Co., Ltd.).

Among these resins, oil-free alkyd resins are preferable because of their excellent adhesion properties.

The amino resin serves as a cross-linking agent for the alkyd resin. A melamine resin, a guanamine resin, and a combination of a melamine resin and a guanamine resin are preferably used as the amino resin. Specific examples of commercially available melamine resins include, but are not limited to, SAIMEL 303 (from Mitsui CYTEC, Ltd.), SUPER BECKAMINE L-105-60 and SUPER BECKAMINE G-821-60 (from DIC Corporation), and ETERMINO 9216-60 (from Eternal Chemical Co., Ltd.). Specific examples of commercially available guanamine resins include, but are not limited to, DELAMINE T-100-S and DELAMINE CTU-100 (Fuji Kasei Kogyo Co., Ltd.), SUPER BECKAMINE TD-126 (from DIC Corporation), and ETERMINO 9411-75 (from Eternal Chemical Co., Ltd.).

Further, polyamide resins are also preferable for the binder resin because the polyamide resins are capable of finely dispersing zeolite and intimately adhering to the charging grid, providing a reliable layer on the charging grid over a long term.

In particular, alcohol-soluble polyamide resins are preferable, such as modified polyamide resins, copolymerized polyamide resins, and copolymerized-modified polyamide resins.

As the modified polyamide resin, a modified nylon 6 in which α-hydrogen atoms are substituted with dimethyl amino groups can be used. Alternatively, a modified nylon 6 in which hydrogen atoms of amide groups are substituted with methoxymethyl groups can also be used. Specific examples of commercially available modified polyamide resins include, but are not limited to, FR-101, FR-104, and FR-105 (from Namariichi Co., Ltd.), and F30K, MF-30, and EF-30T (from Nagase ChemteX Corporation).

Specific examples of usable copolymerized polyamide resins include, but are not limited to, trinary or quaternary copolymers such as nylon 6/66/610, nylon 6/66/12, nylon 6/69/12, nylon 6/612/12, nylon 6/66/69/12, nylon 6/66/11/12, nylon 6/66/610/12, nylon 6/66/612/12, and nylon 6/66/bis(4-aminocyclohexyl)methane-6. Specific examples of commercially available copolymerized polyamide resins include, but are not limited to, CM-4000, CM-4001, and CM-8000 (from Toray Industries, Inc.).

Specific examples of commercially available copolymerized-modified polyamide resins include, but are not limited to, FR-301 (from Namariichi Co., Ltd.).

Among these resins, copolymerized polyamide resins are preferable because of having excellent adhesion properties. In addition, zeolites can be finely dispersed therein.

When an acid catalyst is added to the modified polyamide resin or the copolymerized-modified polyamide resin, intermolecular cross-linking is accelerated therein, providing better adhesion. As the acid catalyst, both organic and inorganic acids can be used.

Specific examples of suitable organic acids include, but are not limited to, aliphatic monocarboxylic acids such as formic acid, acetic acid, propionic acid, butyric acid, isobutyric acid, pentanoic acid, pivalic acid, lauric acid, myristic acid, stearic acid, acrylic acid, propiolic acid, methacrylic acid, crotonic acid, and oleic acid; aliphatic dicarboxylic acids such as oxalic acid, malonic acid, succinic acid, glutaric acid, adipic acid, maleic acid, and fumaric acid; aromatic carboxylic acids such as benzoic acid, phthalic acid, isophthalic acid, terephthalic acid, toluic acid, naphthoic acid, and cinnamic acid; heterocyclic carboxylic acids such as 2-furoic acid, nicotinic acid, isonicotinic acid; aliphatic oxycarboxylic acids such as glycolic acid, lactic acid, hydracrylic acid, α-oxybutyric acid, glyceric acid, tartronic acid, malic acid, tartaric acid, and citric acid; aromatic oxycarboxylic acid such as salicylic acid, m-oxybenzoic acid, p-oxybenzoic acid, gallic acid, mandelic acid, and tropic acid; aliphatic aminocarboxylic acids such as glycine, alanine, valine, leucine, isoleucine, serine, threonine, cysteine, cystine, methionine, aspartic acid, glutamic acid, lysine, and arginine; aminocarboxylic acids having an aromatic ring such as phenylalanine and tyrosine; and amino acids having a heterocyclic ring such as histidine, tryptophan, proline, and oxyproline.

Specific examples of suitable inorganic acids include, but are not limited to, sulfuric acid, hydrochloric acid, nitric acid, phosphoric acid, boric acid, carbonic acid, sulfurous acid, nitrous acid, phosphorous acid, boronic acid, hydrogen peroxide, perchloric acid, and nitrogen peroxide.

These acids can be used alone or in combination.

The layer formed on the charging grid further includes a conductive agent to control the resistance of the charging grid. If the layer includes no conductive agent, the layer may have a very high volume resistance because neither the zeolite nor the binder resin is conductive. In this case, the charging grid cannot function as a control electrode, providing a similar performance to that of the related-art corotron charger. As a consequence, abnormal images with raindrop-like marks may be produced. When the layer has a volume resistance of $1.0\times10^{10}\Omega$ or less, abnormal images with raindrop-like marks are not produced. In order to reliably produce higher quality images, the layer preferably has a volume resistance of $1.0\times10^{9}\Omega$ or less, and more preferably $1.0\times10^{8}\Omega$ or less.

The conductive agent is dispersed in the binder resin. Specific examples of suitable conductive agents include, but are not limited to, fine particles of metals such as graphite, nickel, copper, and silver; metal oxides such as antimony-doped tin oxide (ATO), indium tin oxide (ITO), tin oxide, and zinc antimonate; and activated carbon. Since the charging grid is continuously exposed to electric discharge, the conductive agent is required to be resistant to the electric discharge. Among the above-described materials, metals such as graphite and nickel, and non-doped metal oxides such as tin oxide and zinc antimonate are preferable because these materials provide reliable resistance even with long-term use regardless of environmental variations.

In order not to suppress the other functions of the layer, such as intimate adhesion to the charging grid and sufficient removal of discharge products, the layer preferably includes the conductive agent in an amount as small as possible. Accordingly, each of the fine particles of the conductive agent preferably has a conductivity as high as possible and a particle diameter as small as possible. In the present embodiment, conductive fine particles having a particle diameter of from 0.01 to 15 mm are used. Binder resins having conductivity can be also used as the conductive agent. Two or more kinds of conductive agents can be used in combination.

The layer is formed on the charging grid as follows, for example.

First, 5 to 10% by weight of a binder resin is dissolved in a solvent, and then a zeolite and a conductive agent are added thereto while the solvent is agitated. Thus, a coating liquid is prepared. The coating liquid preferably includes solid components in an amount of 30% by weight or less in a case used for spray coating.

The coating liquid can be applied to the charging grid by dipping, spray coating, roller coating, electrophoretic deposition, and the like method. From the viewpoint of even application, spray coating is most preferable.

The charging grid is stretched taut from both ends in a direction of the long axis thereof, and then set to a cylindrical base having a diameter of 30 mm so that the direction of the long axis is equal to that of the cylindrical axis. The cylindrical axis is horizontally disposed, and the cylinder is rotated at a rotation speed of 170 rpm in a circumferential direction. The coating liquid is sprayed onto the charging grid by horizontally scanning the spray at a scanning speed of 10 mm/sec while the charging grid is rotated. In order to apply the coating liquid on both sides of the charging grid, the charging grid is set to the cylindrical base forming a gap of 3 mm there between. The charging grid, one side of which is coated by the coating liquid, is allowed to settle for 10 minutes. After replenishing the coating liquid, the other side of the charging grid is also coated by the coating liquid. The charging gird both sides of which are thus coated is dried in a drier for 30 minutes at 130° C. so that layers are formed and fixed on both sides of the charging grid. The resultant layers have a thickness of 30 μm.

In a case the charging grid is composed of wires, layers may be formed on the surfaces of the wires.

As described above, the conductive agent may be previously added to the coating liquid. Alternatively, the conductive agent may be applied to or buried in a layer composed of the binder resin and the zeolite only.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Photoreceptor 1

An undercoat layer coating liquid including 6 parts of an alkyd resin (BECKOSOL 1307-60-EL from DIC Corporation), 4 parts of a melamine resin (SUPER BECKAMINE G-821-60 from DIC Corporation), 40 parts of a titanium oxide, and 50 parts of methyl ethyl ketone, a charge generation layer coating liquid including 6 parts of Y-form titanyl phthalocyanine, 70 parts of a 15% xylene-butanol solution of a silicone resin (KR5240 from Shin-Etsu Chemical Co., Ltd.), and 200 parts of 2-butanone, and a charge transport layer coating liquid including 25 parts of a charge transport material having the following formula (A), 30 parts of a bisphenol-Z type polycarbonate (IUPILON Z300 from Mitsubishi G as Chemical Company, Inc.), and 200 parts of 1,2-dichloroethane, were sequentially applied to an aluminum cylinder having a diameter of 100 mm and dried, in this order. Thus, a photoreceptor (1) including, in order from an innermost side thereof, an undercoat layer having a thickness of 3.5 μm, a charge generation layer having a thickness of 0.2 μm, and a charge transport layer having a thickness of 32 μm was prepared.

(A)

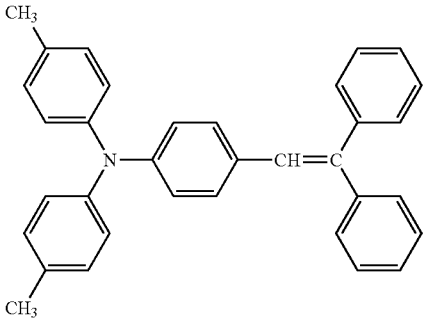

Preparation of Photoreceptor 2

The procedure for preparation of the photoreceptor (1) was repeated except that the charge transport layer coating liquid was replaced with another charge transport layer coating liquid including 20 parts of the charge transport material having the formula (A), 30 parts of a bisphenol-Z type polycarbonate (IUPILON Z300 from Mitsubishi G as Chemical Company, Inc.), and 200 parts of 1,2-dichloroethane. Thus, a charge transport layer having a thickness of 22 μm was formed.

Further, a cross-linked charge transport layer coating liquid including 10 parts of a radical polymerizable trifunctional monomer having no charge transport structure (trimethylolpropane triacrylate having a molecular weight of 296 and 3 functional groups, KAYARAD TMPTA from Nippon Kayaku Co., Ltd.), 10 parts of a polymerizable charge transport material having the following formula (B), 1 part of a photopolymerization initiator (1-hydroxy-cyclohexyl-phenyl-ketone, IRGACURE 184 from Ciba Specialty Chemicals Inc.), and 100 parts of tetra hydrofuran, was spray-coated on the charge transport layer and dried naturally for 20 minutes, and then exposed to a light beam emitted from a 120 mm-distant metal halide lamp with a power of 160 W/cm at an intensity of 500 mW/cm$^2$ for 60 seconds, followed by drying for 20 minutes at 130° C. Thus, a photoreceptor (2) including, in order from an innermost side thereof, an undercoat layer having a thickness of 3.5 μm, a charge generation layer having a thickness of 0.2 μm, a charge transport layer having a thickness of 22 μm, and a cross-linked charge transport layer having a thickness of 5.2 μm was prepared.

(B)

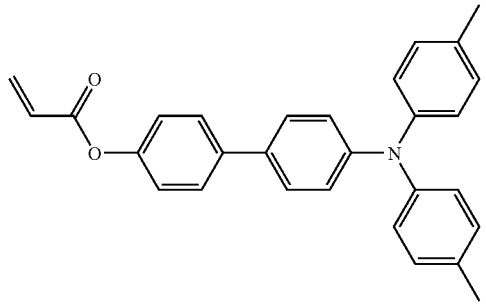

Preparation of Photoreceptor 3

A charge blocking layer coating liquid including 5 parts of N-methoxymethylated nylon (FR101 from Namariichi Co., Ltd.), 70 parts of methanol, and 30 parts of n-butanol was dip-coated on an aluminum cylinder having a length of 360 mm and a diameter of 100 mm, and dried for 20 minutes at 130° C. Thus, a charge blocking layer having a thickness of about 0.5 μm was formed.

A moiré prevention layer coating liquid including 126 parts of a titanium oxide (CR-EL from Ishihara Sangyo Kaisha Ltd.), 33.6 parts of an alkyd resin (BECKOLITE M6401-50-S from DIC Corporation), 18.7 parts of a melamine resin (SUPER BECKAMINE L-121-60 from DIC Corporation), and 100 parts of 2-butanone was dip-coated on the charge blocking layer, and dried for 30 minutes at 130° C. Thus, a moiré prevention layer having a thickness of about 3.5 μm was formed.

A charge generation layer coating liquid including 6 parts of Y-form titanyl phthalocyanine, 70 parts of a silicone resin solution (KR5240 from Shin-Etsu Chemical Co., Ltd.), and 200 parts of methyl ethyl ketone was dip-coated on the moiré prevention layer, and dried for 20 minutes at 100° C. Thus, a charge generation layer having a thickness of about 0.2 μm was formed.

A charge transport layer coating liquid including 10 parts of a polycarbonate Z (from Teijin Chemicals Ltd.), 7 parts of a charge transport material having the following formula (C), 80 parts of tetra hydrofuran, and 0.002 parts of a silicone oil (KF50-100 cs from Shin-Etsu Chemical Co., Ltd.) was dip-coated on the charge generation layer, and dried for 20 minutes at 130° C. Thus, a charge transport layer having a thickness of about 20 μm was formed.

(C)

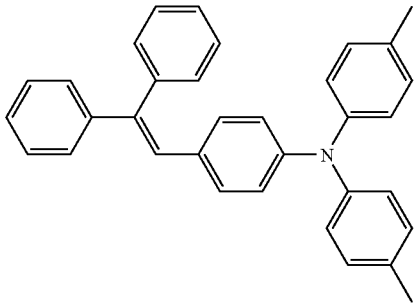

Further, a cross-linked surface layer coating liquid including 10 parts of a trifunctional acrylic resin (KAYARAD TMPTA from Nippon Kayaku Co., Ltd.), the polymerizable charge transport material having the formula (B), 1 part of a polymerization initiator (IRGACURE 184 from Ciba Specialty Chemicals Inc.), and 50 parts of tetrahydrofuran was spray-coated on the charge transport layer, and then exposed to a ultraviolet light beam for 60 seconds emitted from a UV lamp system (from Ushio Inc.), followed by frying for 30 minutes at 70° C. Thus, a cross-linked surface layer having a thickness of about 7 μm was formed, resulting in preparation of a photoreceptor (3).

Example 1

A coating liquid in which 5 parts of a zeolite, 3 parts of a conductive agent, and 2 parts of a binder resin were dissolved or dispersed in a solvent was prepared. The coating liquid includes 30% by weight of solid components.

As the zeolite, a β-form zeolite containing hydrogen ion (980 HOA from Tosoh Corporation) was used. As the conductive agent, a zinc antimonate (CELNAX CX-Z210IP from Nissan Chemical Industries, Ltd.) was used. As the binder resin, a mixture of 3 parts of an alkyd resin (BECKOSOL 1307-60-EL from DIC Corporation) and 2 parts of a melamine resin (SUPER BECKAMINE G-821-60 from DIC Corporation) was used. As the solvent, 2-butanone was used.

The coating liquid was spray-coated on a charging grid of a corona charger. The resultant corona charger was subjected to the following evaluations (1) to (3) using the above-prepared photoreceptor (2) that has an outermost protective layer.

(1) Evaluation of Adhesiveness of Layer

In order to evaluate the adhesiveness of the resultant layer to the charging grid, the layer was rubbed with a piece of waste cloth for 10 times applying a strong force or a weak force. The same evaluation was performed after a 200-hour electric discharge in order to evaluate durability. The results are graded as follows.

A: The layer was not adhered to a piece of waste cloth even when being rubbed with a strong forth.

B: The layer was slightly adhered to a piece of waste cloth when being rubbed with a strong forth. Suitable for practical use.

C: The layer was slightly adhered to a piece of waste cloth even when being rubbed with a weak forth. Suitable for practical use.

D: The layer was significantly adhered to a piece of waste cloth even when being rubbed with a weak forth. Not suitable for practical use.

(2) Evaluation of Controllability of Charging

The charging grid was mounted on an image forming apparatus IMAGIO NEO 1050PRO (from Ricoh Co., Ltd.) at 10° C. and 15% RH. A voltage was applied to the charging grid so that a constant current flowed in the charging wire, resulting in the occurrence of corona discharge. The surface potential of the photoreceptor (i.e., a charging target) was measured when a voltage of −900 V was applied to the charging grid. Subsequently, a halftone image was produced and visually observed whether raindrop-like marks were present or not.

A: No raindrop-like mark was observed.

B: Raindrop-like marks were slightly observed, but allowable.

D: Raindrop-like marks were observed.

(3) Evaluation of Removability of Discharge Products

The charging grid was mounted on an image forming apparatus IMAGIO NEO 1050PRO (from Ricoh Co., Ltd.) at 10° C. and 15% RH. The image forming apparatus was brought into operation for 3 hours, and then powered down and left at rest for 15 hours. The image forming apparatus was powered up again, and a halftone image was produced and visually observed whether the image density was even or not. At the same time, the surface potential of the photoreceptor was measured, particularly a portion thereof which was disposed immediately below the corona charger while being left.

A: The image density was even.

B: The image density was slightly uneven at an area corresponding to a portion of the photoreceptor which was disposed immediately below the corona charger while being left, but allowable.

C: The image density was uneven at an area corresponding to a portion of the photoreceptor which was disposed immediately below the corona charger while being left. Unallowable.

D: The image density was significantly uneven at an area corresponding to a portion of the photoreceptor which was disposed immediately below the corona charger while being left. Unallowable.

Example 2

The procedure in Example 1 was repeated except that an activated carbon (RP-20 from Kuraray Chemical Co., Ltd.) was used as the conductive agent.

Example 3

The procedure in Example 1 was repeated except that a tin oxide (S2000 from Mitsubishi Materials Corporation) was used as the conductive agent.

Example 4

The procedure in Example 1 was repeated except that an indium tin oxide (ITO) (SUFP from Sumitomo Metal Mining Co., Ltd.) was used as the conductive agent.

Example 5

The procedure in Example 1 was repeated except that an antimony-doped tin oxide (ATO) (TWU-1 from Jemco Inc.) was used as the conductive agent.

Example 6

The procedure in Example 1 was repeated except that an alkyd resin (BECKOSOL 1307-60-EL from DIC Corporation) was used as the binder resin.

Example 7

The procedure in Example 1 was repeated except that a melamine resin (SUPER BECKAMINE G-821-60 from DIC Corporation) was used as the binder resin.

Example 8

The procedure in Example 1 was repeated except that a polyurethane resin (NIPPOLAN 3022 from Nippon Polyurethane Industry Co., Ltd.) was used as the binder resin.

Example 9

The procedure in Example 1 was repeated except that an epoxy resin (827 from Japan Epoxy Resins Co., Ltd.) was used as the binder resin.

Example 10

The procedure in Example 1 was repeated except that a polyethylene resin (from WAKO) was used as the binder resin.

Example 11

The procedure in Example 1 was repeated except that a polystyrene resin (from WAKO) was used as the binder resin.

Example 12

The procedure in Example 1 was repeated except that a bisphenol Z type polycarbonate (IUPILON Z300 from Mitsubishi G as Chemical Company, Inc.) was used as the binder resin.

Example 13

The procedure in Example 1 was repeated except that the amounts of the zeolite, the conductive agent, and the binder resin were changed to 7 parts, 2 parts, and 1 part, respectively.

Example 14

The procedure in Example 1 was repeated except that the amounts of the zeolite, the conductive agent, and the binder resin were changed to 5 parts, 2 parts, and 3 parts, respectively.

Example 15

The procedure in Example 1 was repeated except that the amounts of the zeolite, the conductive agent, and the binder resin were changed to 2 parts, 2 parts, and 6 parts, respectively.

Example 16

The procedure in Example 1 was repeated except that the amounts of the zeolite, the conductive agent, and the binder resin were changed to 5 parts, 4 parts, and 1 part, respectively.

Example 17

The procedure in Example 1 was repeated except that the amounts of the zeolite, the conductive agent, and the binder resin were changed to 4 parts, 5 parts, and 1 part, respectively.

Example 18

The procedure in Example 1 was repeated except that the amounts of the zeolite, the conductive agent, and the binder resin were changed to 8 parts, 1 part, and 1 part, respectively.

Example 19

The procedure in Example 1 was repeated except that the amounts of the zeolite, the conductive agent, and the binder resin were changed to 1 part, 5 parts, and 4 parts, respectively.

Example 20

The procedure in Example 1 was repeated except that the amounts of the zeolite, the conductive agent, and the binder resin were changed to 3 parts, 6 parts, and 1 part, respectively.

Example 21

The procedure in Example 1 was repeated except that the amounts of the zeolite, the conductive agent, and the binder resin were changed to 2.5 parts, 1 part, and 6.5 parts, respectively.

Example 22

The procedure in Example 1 was repeated except that the amounts of the zeolite, the conductive agent, and the binder resin were changed to 8.5 parts, 1 part, and 0.5 parts, respectively.

Example 23

The procedure in Example 1 was repeated except that the amounts of the zeolite, the conductive agent, and the binder resin were changed to 8.5 parts, 1 part, and 0.5 parts, respectively, and a melamine resin (SUPER BECKAMINE G-821-60 from DIC Corporation) was used as the binder resin.

Example 24

The procedure in Example 1 was repeated except that the amounts of the zeolite, the conductive agent, and the binder resin were changed to 8.5 parts, 1 part, and 0.5 parts, respectively, and a polystyrene resin (from WAKO) was used as the binder resin.

Example 25

The procedure in Example 1 was repeated except that the amounts of the zeolite, the conductive agent, and the binder resin were changed to 9 parts, 0.5 parts, and 0.5 parts, respectively, an antimony-doped tin oxide (ATO) (TWU-1 from Jemco Inc.) was used as the conductive agent, and a bisphenol Z type polycarbonate (IUPILON Z300 from Mitsubishi G as Chemical Company, Inc.) was used as the binder resin.

Example 26

The procedure in Example 1 was repeated except that the amounts of the zeolite, the conductive agent, and the binder resin were changed to 0.5 parts, 9 parts, and 0.5 parts, respectively, an antimony-doped tin oxide (ATO) (TWU-1 from Jemco Inc.) was used as the conductive agent, and a bisphenol Z type polycarbonate (IUPILON Z300 from Mitsubishi G as Chemical Company, Inc.) was used as the binder resin.

Example 27

The procedure in Example 1 was repeated except that the amounts of the zeolite, the conductive agent, and the binder resin were changed to 0.5 parts, 0.5 parts, and 9 parts, respectively, an antimony-doped tin oxide (ATO) (TWU-1 from Jemco Inc.) was used as the conductive agent, and a bisphenol Z type polycarbonate (IUPILON Z300 from Mitsubishi G as Chemical Company, Inc.) was used as the binder resin.

Example 28

The procedure in Example 1 was repeated except that the evaluations of the resultant corona charger were performed using the photoreceptor (1) that has no outermost protective layer.

Example 29

The procedure in Example 1 was repeated except that an activated carbon (RP-20 from Kuraray Chemical Co., Ltd.) was used as the conductive agent, and the evaluations of the resultant corona charger were performed using the photoreceptor (1) that has no outermost protective layer.

Example 30

The procedure in Example 1 was repeated except that an A-form zeolite containing sodium ion (A-4 from Tosoh Corporation) was used as the zeolite, and the evaluations of the resultant corona charger were performed using the photoreceptor (3) that has an outermost protective layer.

Example 31

The procedure in Example 30 was repeated except that an X-form zeolite containing sodium ion (F-9 from Tosoh Corporation) was used as the zeolite.

Example 32

The procedure in Example 30 was repeated except that a Y-form zeolite containing sodium ion (HSZ-320NAA from Tosoh Corporation) was used as the zeolite.

Example 33

The procedure in Example 30 was repeated except that a mordenite-form zeolite containing sodium ion (HSZ-642NAA from Tosoh Corporation) was used as the zeolite.

Example 34

The procedure in Example 30 was repeated except that a Y-form zeolite containing hydrogen ion (HSZ-320HOA from Tosoh Corporation) was used as the zeolite.

Example 35

The procedure in Example 30 was repeated except that a mordenite-form zeolite containing hydrogen ion (HSZ-690HOA from Tosoh Corporation) was used as the zeolite.

Example 36

The procedure in Example 30 was repeated except that a beta-form zeolite containing hydrogen ion (HSZ-940HOA from Tosoh Corporation) was used as the zeolite.

Example 37

The procedure in Example 30 was repeated except that an A-form zeolite containing potassium ion (A-3 from Tosoh Corporation) was used as the zeolite.

Example 38

The procedure in Example 30 was repeated except that an A-form zeolite containing calcium ion (A-5 from Tosoh Corporation) was used as the zeolite.

Example 39

The procedure in Example 30 was repeated except that a Y-form zeolite containing ammonium ion (HSZ-341NHA from Tosoh Corporation) was used as the zeolite.

Comparative Example 1

The procedure in Example 1 was repeated except that the coating liquid was not spray-coated on the charging grid of the corona charger.

Comparative Example 2

The procedure in Example 1 was repeated except that the amounts of the zeolite, the conductive agent, and the binder resin were changed to 9 parts, 0 part, and 1 part, respectively.

Comparative Example 3

The procedure in Example 1 was repeated except that the amounts of the zeolite, the conductive agent, and the binder resin were changed to 8 parts, 0 part, and 2 parts, respectively.

Comparative Example 4

The procedure in Example 1 was repeated except that the amounts of the zeolite, the conductive agent, and the binder resin were changed to 1 part, 0 part, and 9 parts, respectively.

Comparative Example 5

The procedure in Example 1 was repeated except that the amounts of the zeolite, the conductive agent, and the binder resin were changed to 0 part, 9 parts, and 1 part, respectively.

Comparative Example 6

The procedure in Example 1 was repeated except that the coating liquid was not spray-coated on the charging grid of the corona charger, and the evaluations of the resultant corona charger were performed using the photoreceptor (1) that has no outermost protective layer.

Comparative Example 7

The procedure in Example 1 was repeated except that the amounts of the zeolite, the conductive agent, and the binder resin were changed to 9 parts, 0 part, and 1 part, respectively, and the evaluations of the resultant corona charger were performed using the photoreceptor (1) that has no outermost protective layer.

Comparative Example 8

The procedure in Example 30 was repeated except that the coating liquid was not spray-coated on the charging grid of the corona charger.

Comparative Example 9

The procedure in Example 30 was repeated except that the amounts of the zeolite, the conductive agent, and the binder resin were changed to 0 part, 8 parts, and 2 parts, respectively.

Comparative Example 10

The procedure in Example 30 was repeated except that the amounts of the zeolite, the conductive agent, and the binder resin were changed to 8 parts, 2 parts, and 0 part, respectively.

Comparative Example 11

The procedure in Example 30 was repeated except that the amounts of the zeolite, the conductive agent, and the binder resin were changed to 8 parts, 0 part, and 2 parts, respectively.

Comparative Example 12

The procedure in Example 37 was repeated except that the amounts of the zeolite, the conductive agent, and the binder resin were changed to 8 parts, 2 parts, and 0 part, respectively.

Comparative Example 13

The procedure in Example 37 was repeated except that the amounts of the zeolite, the conductive agent, and the binder resin were changed to 8 parts, 0 part, and 2 parts, respectively.

The compositions of the coating layer of the charging grid in Examples 1 to 29 and Comparative Examples 1 to 7 are shown in Table 1.

TABLE 1

| | Charging Gird Composition of Coating Layer | | | | | | |
|---|---|---|---|---|---|---|---|
| | Zeolite | | Conductive Agent | | Binder Resin | | |
| | Product Name | Content (% by weight) | Chemical Species | Content (% by weight) | Chemical Species | Content (% by weight) | Photoreceptor |
| Ex. 1 | 980HOA | 50 | Zinc Antimonate | 30 | Alkyd-Melamine | 20 | (2) |
| Ex. 2 | 980HOA | 50 | Activated Carbon | 30 | Alkyd-Melamine | 20 | (2) |
| Ex. 3 | 980HOA | 50 | Tin Oxide | 30 | Alkyd-Melamine | 20 | (2) |
| Ex. 4 | 980HOA | 50 | ITO | 30 | Alkyd-Melamine | 20 | (2) |
| Ex. 5 | 980HOA | 50 | ATO | 30 | Alkyd-Melamine | 20 | (2) |
| Ex. 6 | 980HOA | 50 | Zinc Antimonate | 30 | Alkyd | 20 | (2) |
| Ex. 7 | 980HOA | 50 | Zinc Antimonate | 30 | Melamine | 20 | (2) |
| Ex. 8 | 980HOA | 50 | Zinc Antimonate | 30 | Polyurethane | 20 | (2) |
| Ex. 9 | 980HOA | 50 | Zinc Antimonate | 30 | Epoxy | 20 | (2) |
| Ex. 10 | 980HOA | 50 | Zinc Antimonate | 30 | Polyethylene | 20 | (2) |
| Ex. 11 | 980HOA | 50 | Zinc Antimonate | 30 | Polystyrene | 20 | (2) |
| Ex. 12 | 980HOA | 50 | Zinc Antimonate | 30 | Polycarbonate | 20 | (2) |
| Ex. 13 | 980HOA | 70 | Zinc Antimonate | 20 | Alkyd-Melamine | 10 | (2) |
| Ex. 14 | 980HOA | 50 | Zinc Antimonate | 20 | Alkyd-Melamine | 30 | (2) |
| Ex. 15 | 980HOA | 20 | Zinc Antimonate | 20 | Alkyd-Melamine | 60 | (2) |
| Ex. 16 | 980HOA | 50 | Zinc Antimonate | 40 | Alkyd-Melamine | 10 | (2) |
| Ex. 17 | 980HOA | 40 | Zinc Antimonate | 50 | Alkyd-Melamine | 10 | (2) |
| Ex. 18 | 980HOA | 80 | Zinc Antimonate | 10 | Alkyd-Melamine | 10 | (2) |
| Ex. 19 | 980HOA | 10 | Zinc Antimonate | 50 | Alkyd-Melamine | 40 | (2) |
| Ex. 20 | 980HOA | 30 | Zinc Antimonate | 60 | Alkyd-Melamine | 10 | (2) |
| Ex. | 980HOA | 25 | Zinc | 10 | Alkyd-Melamine | 65 | (2) |

TABLE 1-continued

| | Charging Gird Composition of Coating Layer | | | | | | |
|---|---|---|---|---|---|---|---|
| | Zeolite | | Conductive Agent | | Binder Resin | | |
| | Product Name | Content (% by weight) | Chemical Species | Content (% by weight) | Chemical Species | Content (% by weight) | Photoreceptor |
| 21 | | | Antimonate | | | | |
| Ex. 22 | 980HOA | 85 | Zinc Antimonate | 10 | Alkyd-Melamine | 5 | (2) |
| Ex. 23 | 980HOA | 85 | Zinc Antimonate | 10 | Melamine | 5 | (2) |
| Ex. 24 | 980HOA | 85 | Zinc Antimonate | 10 | Polystyrene | 5 | (2) |
| Ex. 25 | 980HOA | 90 | ATO | 5 | Polycarbonate | 5 | (2) |
| Ex. 26 | 980HOA | 5 | ATO | 90 | Polycarbonate | 5 | (2) |
| Ex. 27 | 980HOA | 5 | ATO | 5 | Polycarbonate | 90 | (2) |
| Ex. 28 | 980HOA | 50 | Zinc Antimonate | 30 | Alkyd-Melamine | 20 | (1) |
| Ex. 29 | 980HOA | 50 | Activated Carbon | 30 | Alkyd-Melamine | 20 | (1) |
| Comp. Ex. 1 | — | 0 | — | 0 | — | 0 | (2) |
| Comp. Ex. 2 | 980HOA | 90 | — | 0 | Alkyd-Melamine | 10 | (2) |
| Comp. Ex. 3 | 980HOA | 80 | — | 0 | Alkyd-Melamine | 20 | (2) |
| Comp. Ex. 4 | 980HOA | 10 | — | 0 | Alkyd-Melamine | 90 | (2) |
| Comp. Ex. 5 | — | 0 | Zinc Antimonate | 90 | Alkyd-Melamine | 10 | (2) |
| Comp. Ex. 6 | — | 0 | — | 0 | — | 0 | (1) |
| Comp. Ex. 7 | 980HOA | 90 | — | 0 | Alkyd-Melamine | 10 | (1) |

The evaluation results of Examples 1 to 29 and Comparative Examples 1 to 7 are shown in Tables 2-1, 2-2, and 2-3.

TABLE 2-1

| | Evaluation (1) | |
|---|---|---|
| | Initial Stage | After 200-hour Discharge |
| Ex. 1 | A | A |
| Ex. 2 | B | B |
| Ex. 3 | A | A |
| Ex. 4 | A | A |
| Ex. 5 | A | A |
| Ex. 6 | A | B |
| Ex. 7 | A | B |
| Ex. 8 | A | B |
| Ex. 9 | A | B |
| Ex. 10 | B | B |
| Ex. 11 | B | B |
| Ex. 12 | B | B |
| Ex. 13 | A | A |
| Ex. 14 | A | A |
| Ex. 15 | A | A |
| Ex. 16 | A | A |
| Ex. 17 | A | A |
| Ex. 18 | A | A |
| Ex. 19 | A | A |
| Ex. 20 | A | B |
| Ex. 21 | A | A |
| Ex. 22 | A | B |
| Ex. 23 | B | B |
| Ex. 24 | B | C |
| Ex. 25 | B | C |
| Ex. 26 | B | C |
| Ex. 27 | A | B |

TABLE 2-1-continued

| | Evaluation (1) | |
|---|---|---|
| | Initial Stage | After 200-hour Discharge |
| Ex. 28 | A | A |
| Ex. 29 | B | B |
| Comp. Ex. 1 | — | — |
| Comp. Ex. 2 | A | A |
| Comp. Ex. 3 | A | A |
| Comp. Ex. 4 | A | A |
| Comp. Ex. 5 | B | B |
| Comp. Ex. 6 | — | — |
| Comp. Ex. 7 | B | B |

It is apparent from Table 2-1 that the coating layer has a high strength when the binder resin is a thermosetting resin. Specifically, when the binder resin is an alkyd-melamine resin, the coating layer can keep a high strength even after a long-term use. In particular, when the content of the binder resin is from 10 to 60% by weight, the coating layer is more intimately adhered to the charging grid, the photoreceptor is more reliably charged, and discharge products are more sufficiently removed.

TABLE 2-2

| | Evaluation (2) | | |
|---|---|---|---|
| | Surface Potential of Photoreceptor (−V) | Raindrop-like Marks Initial Stage | Raindrop-like Marks After 200-hour Discharge |
| Ex. 1 | 800 | A | A |
| Ex. 2 | 810 | A | B |
| Ex. 3 | 810 | A | A |
| Ex. 4 | 790 | A | B |
| Ex. 5 | 800 | A | B |
| Ex. 6 | 800 | A | A |
| Ex. 7 | 790 | A | A |
| Ex. 8 | 800 | A | A |
| Ex. 9 | 810 | A | A |
| Ex. 10 | 800 | A | A |
| Ex. 11 | 810 | A | A |
| Ex. 12 | 810 | A | A |
| Ex. 13 | 800 | A | A |
| Ex. 14 | 810 | A | A |
| Ex. 15 | 790 | A | A |
| Ex. 16 | 810 | A | A |
| Ex. 17 | 800 | A | A |
| Ex. 18 | 830 | B | A |
| Ex. 19 | 800 | A | A |
| Ex. 20 | 790 | A | A |
| Ex. 21 | 830 | B | B |
| Ex. 22 | 830 | B | B |
| Ex. 23 | 830 | B | B |
| Ex. 24 | 830 | B | B |
| Ex. 25 | 850 | B | B |
| Ex. 26 | 800 | A | A |
| Ex. 27 | 840 | B | B |
| Ex. 28 | 790 | A | A |
| Ex. 29 | 790 | A | B |
| Comp. Ex. 1 | 800 | A | A |
| Comp. Ex. 2 | 1030 | D | D |
| Comp. Ex. 3 | 1000 | D | D |
| Comp. Ex. 4 | 1050 | D | D |
| Comp. Ex. 5 | 790 | A | A |
| Comp. Ex. 6 | 790 | A | A |
| Comp. Ex. 7 | 1000 | D | D |

It is apparent from Table 2-2 that the surface potential of the photoreceptor excesses the voltage applied to the charging grid and the resultant image is uneven when the coating layer includes no conductive agent. In other words, the photoreceptor is not reliably charged when the coating layer includes no conductive agent. By contrast, when the coating layer includes a conductive agent, the surface potential of the photoreceptor is similar to that in a case the coating layer is not formed on the charging grid. In other words, the photoreceptor is reliably charged when the coating layer includes a conductive agent. In particular, when the content of the conductive agent is from 20 to 50% by weight, the photoreceptor is more reliably charged, the coating layer is more intimately adhered to the charging grid, and discharge products are more sufficiently removed.

TABLE 2-3

| | Evaluation (3) | | | |
|---|---|---|---|---|
| | Produced NOx (μl) | Image Density Unevenness Initial Stage | Image Density Unevenness After 200-hour Discharge | Image Blurring |
| Ex. 1 | 0.26 | A | B | A |
| Ex. 2 | 0.30 | A | B | A |
| Ex. 3 | 0.28 | A | B | A |
| Ex. 4 | 0.26 | A | B | A |
| Ex. 5 | 0.31 | A | B | A |

TABLE 2-3-continued

| | Evaluation (3) | | | |
|---|---|---|---|---|
| | Produced NOx (μl) | Image Density Unevenness Initial Stage | Image Density Unevenness After 200-hour Discharge | Image Blurring |
| Ex. 6 | 0.27 | A | B | A |
| Ex. 7 | 0.32 | A | B | A |
| Ex. 8 | 0.36 | A | B | A |
| Ex. 9 | 0.34 | A | B | A |
| Ex. 10 | 0.33 | A | B | A |
| Ex. 11 | 0.32 | A | B | A |
| Ex. 12 | 0.37 | A | B | A |
| Ex. 13 | 0.25 | A | B | A |
| Ex. 14 | 0.29 | A | B | A |
| Ex. 15 | 0.38 | A | B | A |
| Ex. 16 | 0.37 | A | B | A |
| Ex. 17 | 0.36 | A | B | A |
| Ex. 18 | 0.21 | A | B | A |
| Ex. 19 | 0.46 | B | B-C | B |
| Ex. 20 | 0.34 | B | B-C | B |
| Ex. 21 | 0.40 | A | B | A |
| Ex. 22 | 0.22 | A | B | A |
| Ex. 23 | 0.21 | A | B | A |
| Ex. 24 | 0.23 | A | B | A |
| Ex. 25 | 0.21 | A | B | A |
| Ex. 26 | 0.47 | B | B-C | B |
| Ex. 27 | 0.35 | B | B-C | B |
| Ex. 28 | 0.26 | A | B | A |
| Ex. 29 | 0.25 | A | B | A |
| Comp. Ex. 1 | 1.43 | D | D | D |
| Comp. Ex. 2 | 0.23 | A | B | A |
| Comp. Ex. 3 | 0.33 | A | B | A |
| Comp. Ex. 4 | 0.70 | B | B-C | B |
| Comp. Ex. 5 | 1.10 | C | D | D |
| Comp. Ex. 6 | 1.60 | C | C | D |
| Comp. Ex. 7 | 0.22 | A | B | A |

It is apparent from Table 2-3 that corona chargers including a charging grid having a coating layer including a zeolite are capable of suppressing production of NOx, effectively removing discharge products, and suppressing the occurrence of image density unevenness and image blurring. It is more effective to use such a corona charger in combination with a photoreceptor having an outermost protective layer. In particular, when the content of the zeolite is from 20 to 70% by weight, discharge products are more effectively removed. When the coating layer includes no zeolite, discharge products cannot be removed.

The crystal forms of the zeolites used in Examples 1 to 36 are shown in Table 3.

TABLE 3

| | Product Name of Zeolite | Crystal Form |
|---|---|---|
| Examples 1 to 29 | 980HOA | Beta |
| Example 30 | A-4 | A |
| Example 31 | F-9 | X |
| Example 32 | 320NAA | Y |
| Example 33 | 642NAA | Mordenite |
| Example 34 | 320HOA | Y |
| Example 35 | 690HOA | Mordenite |
| Example 36 | 940HOA | Beta |

The evaluation results of Examples 30 to 36 and Comparative Examples 8 to 11 are shown in Tables 4-1, 4-2, and 4-3.

TABLE 4-1

| | Evaluation (1) | |
|---|---|---|
| | Initial Stage | After 200-hour Discharge |
| Ex. 30 | A | A |
| Ex. 31 | A | A |
| Ex. 32 | A | A |
| Ex. 33 | A | A |
| Ex. 34 | A | A |
| Ex. 35 | A | A |
| Ex. 36 | A | A |
| Comp. Ex. 8 | — | — |
| Comp. Ex. 9 | A | A |
| Comp. Ex. 10 | D | Avaluative |
| Comp. Ex. 11 | A | A |

It is apparent from Table 4-1 that the coating layer of Comparative Example 10 that includes no binder resin does not reliably adhere to the charging grid, and peels off by electric discharge. By contrast, when the coating layer includes a binder resin to reliably hold a zeolite and a conductive agent, the coating layer reliably adhere to the charging grid for an extended period of time.

TABLE 4-2

| | Evaluation (2) | | |
|---|---|---|---|
| | Surface Potential of | Raindrop-like Marks | |
| | Photoreceptor (−V) | Initial Stage | After 200-hour Discharge |
| Ex. 30 | 805 | A | A |
| Ex. 31 | 810 | A | A |
| Ex. 32 | 805 | A | A |
| Ex. 33 | 800 | A | A |
| Ex. 34 | 800 | A | A |
| Ex. 35 | 795 | A | A |
| Ex. 36 | 800 | A | A |
| Comp. Ex. 8 | 800 | A | A |
| Comp. Ex. 9 | 805 | A | A |
| Comp. Ex. 10 | 805 | A | Avaluative |
| Comp. Ex. 11 | 905 | D | D |

It is apparent from Table 4-2 that the coating layer of Comparative Example 11 that includes no conductive agent produces abnormal images from an early stage. In addition, the surface potential of the photoreceptor excesses the voltage applied to the charging grid.

TABLE 4-3

| | Evaluation (3) Image Density Unevenness | |
|---|---|---|
| | Initial Stage | After 200-hour Discharge |
| Ex. 30 | A | A |
| Ex. 31 | A | A |
| Ex. 32 | A | A |
| Ex. 33 | A | B |
| Ex. 34 | A | A |
| Ex. 35 | A | B |
| Ex. 36 | A | B |
| Comp. Ex. 8 | D | D |
| Comp. Ex. 9 | D | D |
| Comp. Ex. 10 | A | Avaluative |
| Comp. Ex. 11 | A | A |

It is apparent from Table 4-3 that discharge products are effectively removed when the coating layer includes a zeolite. In particular, when the crystal form of the zeolite is A form, X form, or Y form, discharge products are effectively removed even after 200-hour electric discharge.

The cationic species of the zeolites used in Examples 1 to 39 are shown in Table 5.

TABLE 5

| | Product Name of Zeolite | Cationic Species |
|---|---|---|
| Examples 1 to 29 | 980HOA | H |
| Example 30 | A-4 | Na |
| Example 31 | F-9 | Na |
| Example 32 | 320NAA | Na |
| Example 33 | 642NAA | Na |
| Example 34 | 320HOA | H |
| Example 35 | 690HOA | H |
| Example 36 | 940HOA | H |
| Example 37 | A-3 | K |
| Example 38 | A-5 | Ca |
| Example 39 | 341NHA | $NH_4$ |

The evaluation results of Examples 37 to 39 and Comparative Examples 12 to 13 are shown in Tables 6-1, 6-2, and 6-3.

TABLE 6-1

| | Evaluation (1) | |
|---|---|---|
| | Initial Stage | After 200-hour Discharge |
| Ex. 37 | A | A |
| Ex. 38 | A | A |
| Ex. 39 | A | A |
| Comp. Ex. 12 | D | Avaluative |
| Comp. Ex. 13 | A | A |

It is apparent from Table 6-1 that the coating layer of Comparative Example 12 that includes no binder resin does not reliably adhere to the charging grid, and peels off by electric discharge. By contrast, when the coating layer includes a binder resin to reliably hold a zeolite and a conductive agent, the coating layer reliably adhere to the charging grid for an extended period of time.

TABLE 6-2

| | Evaluation (2) | | |
|---|---|---|---|
| | Surface Potential of | Raindrop-like Marks | |
| | Photoreceptor (−V) | Initial Stage | After 200-hour Discharge |
| Ex. 37 | 805 | A | A |
| Ex. 38 | 805 | A | A |
| Ex. 39 | 795 | A | A |
| Comp. Ex. 12 | 805 | A | A |
| Comp. Ex. 13 | 905 | D | D |

It is apparent from Table 6-2 that the coating layer of Comparative Example 13 that includes no conductive agent produces abnormal images from an early stage. In addition, the surface potential of the photoreceptor excesses the voltage applied to the charging grid.

TABLE 6-3

| | Evaluation (3) Image Density Unevenness | |
|---|---|---|
| | Initial Stage | After 200-hour Discharge |
| Ex. 37 | A | A |
| Ex. 38 | A | A |
| Ex. 39 | A | B |
| Comp. Ex. 12 | A | Avaluative |
| Comp. Ex. 13 | A | A |

It is apparent from Table 6-3 that discharge products are effectively removed when the coating layer includes a zeolite. In particular, when the cationic species of the zeolite is potassium, calcium, sodium, or hydrogen, discharge products are effectively removed even after 200-hour electric discharge. It means that these cationic species are effectively replaced with discharge products.

Preparation of Photoreceptor 4

An undercoat layer coating liquid including 6 parts of an alkyd resin (BECKOSOL 1307-60-EL from DIC Corporation), 4 parts of a melamine resin (SUPER BECKAMINE G-821-60 from DIC Corporation), 40 parts of a titanium oxide, and 50 parts of methyl ethyl ketone, a charge generation layer coating liquid including 6 parts of Y-form titanyl phthalocyanine, 70 parts of a 15% xylene-butanol solution of a silicone resin (KR5240 from Shin-Etsu Chemical Co., Ltd.), and 200 parts of 2-butanone, and a charge transport layer coating liquid including 25 parts of a charge transport material having the following formula (A), 30 parts of a bisphenol-Z type polycarbonate (IUPILON Z300 from Mitsubishi G as Chemical Company, Inc.), and 200 parts of 1,2-dichloroethane, were sequentially applied to an aluminum cylinder having a diameter of 100 mm and dried, in this order. Thus, in order from an innermost side thereof, an undercoat layer having a thickness of 3.5 μm, a charge generation layer having a thickness of 0.2 μm, and a charge transport layer having a thickness of 22 μm were formed.

(A)

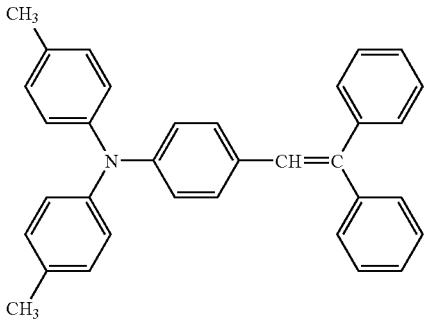

Further, a cross-linked charge transport layer coating liquid including 10 parts of a radical polymerizable trifunctional monomer having no charge transport structure (trimethylolpropane triacrylate having a molecular weight of 296 and 3 functional groups, KAYARAD TMPTA from Nippon Kayaku Co., Ltd.), 10 parts of a polymerizable monofunctional charge transport material having the following formula (B), 1 part of a photopolymerization initiator (1-hydroxy-cyclohexyl-phenyl-ketone, IRGACURE 184 from Ciba Specialty Chemicals Inc.), and 100 parts of tetra hydrofuran, was spray-coated on the charge transport layer and dried naturally for 20 minutes, and then exposed to a light beam emitted from a 120 mm-distant metal halide lamp with a power of 160 W/cm at an intensity of 500 mW/cm$^2$ for 60 seconds, followed by drying for 20 minutes at 130° C. Thus, a photoreceptor (4) including, in order from an innermost side thereof, an undercoat layer having a thickness of 3.5 μm, a charge generation layer having a thickness of 0.2 μm, a charge transport layer having a thickness of 22 μm, and a cross-linked charge transport layer having a thickness of 5.2 μm was prepared.

(B)

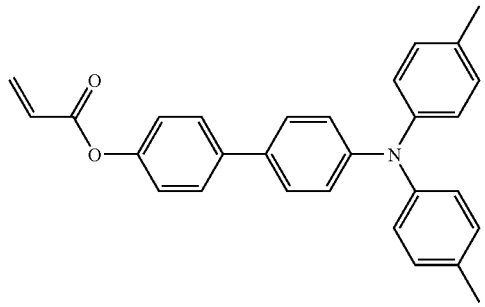

Examples 40 to 51 and Comparative Examples 14 to 19

The procedure for preparation of the coating layer on the charging grid in Example 1 was repeated except that the composition of the coating liquid was change to those shown in Table 7.

The resultant corona charger was subjected to the following evaluations (4) to (6) using the photoreceptor (4).

(4) Measurement of Volume Resistance

The volume resistance of the coating layer was measured using an instrument HIRESTA MODEL HT-201 (from Mitsubishi Chemical Corporation). A voltage of 100 V was applied to the coating layer from two-pronged high voltage application terminals. More specifically, each of the terminals was brought into contact with a portion of the charging grid on which the coating layer was formed and that the coating layer was not formed. The center of the two terminals corresponded to a boundary between the portion of the charging grid on which the coating layer was formed and that on which the coating layer was not formed. A volume resistance was measured 10 seconds after the measurement was started. The measurement was repeated for 3 times, and the measured values were averaged.

(5) Evaluation of Controllability of Charging

The charging grid was mounted on an image forming apparatus IMAGIO NEO 1350PRO (from Ricoh Co., Ltd.) at 10° C. and 15% RH. A voltage was applied to the charging grid so that a constant current flowed in the charging wire, resulting in the occurrence of corona discharge. The surface potential of the photoreceptor was measured when a voltage of −900 V was applied to the charging grid. Subsequently, a halftone image was produced and visually observed whether raindrop-like marks were present or not.

A: No raindrop-like mark was observed.

B: Raindrop-like marks were slightly observed, but allowable.

D: Raindrop-like marks were observed.

(6) Evaluation of Removability of Discharge Products

The charging grid was mounted on an image forming apparatus IMAGIO NEO 1350PRO (from Ricoh Co., Ltd.) at 10° C. and 15% RH. The image forming apparatus was brought into operation to copy 20,000 sheets of A4-size image, and then powered down and left at rest for 12 hours. The image forming apparatus was powered up again, and a halftone image was produced and visually observed whether the image density was even or not. At the same time, the surface potential of the photoreceptor was measured, particularly in a portion which was disposed immediately below the corona charger while being left.

A: The image density was even.

B: The image density was slightly uneven at an area corresponding to a portion of the photoreceptor which was disposed immediately below the corona charger while being left, but allowable.

D: The image density was uneven at an area corresponding to a portion of the photoreceptor which was disposed immediately below the corona charger while being left. Unallowable.

The evaluation results of Examples 40 to 51 and Comparative Examples 14 to 19 are shown in Table 8.

TABLE 8

| | Evaluation | Evaluation (5) | | Evaluation (6) | |
|---|---|---|---|---|---|
| | (4) Volume Resistance (Ω) | Surface Potential of Photoreceptor (−V) | Raindrop-like mark | Difference in Surface Potential (−V) | Image Density Un-evenness |
| Ex. 40 | $5.4 \times 10^9$ | 850 | B | 30 | B |
| Ex. 41 | $2.4 \times 10^9$ | 830 | B | 25 | B |

TABLE 7

| | Composition of Coating Liquid | | | | | | |
|---|---|---|---|---|---|---|---|
| | Zeolite | | Conductive Agent | | Binder Resin | | |
| | Product Name | Content (% by weight) | Chemical Species | Content (% by weight) | Chemical Species | Content (% by weight) | Solvent |
| Ex. 40 | 980HOA | 15 | ITO | 15 | Polycarbonate | 70 | THF |
| Ex. 41 | 980HOA | 20 | ITO | 20 | Polycarbonate | 60 | THF |
| Ex. 42 | 980HOA | 50 | ITO | 30 | Polycarbonate | 20 | THF |
| Ex. 43 | 980HOA | 40 | ITO | 30 | Polycarbonate | 30 | THF |
| Ex. 44 | 980HOA | 30 | ITO | 50 | Polycarbonate | 20 | THF |
| Ex. 45 | 980HOA | 70 | ITO | 10 | Polycarbonate | 20 | THF |
| Ex. 46 | 980HOA | 75 | ITO | 5 | Polycarbonate | 20 | THF |
| Ex. 47 | 980HOA | 50 | Activated Carbon | 30 | Polycarbonate | 20 | THF |
| Ex. 48 | 980HOA | 40 | Tin Oxide | 30 | Polycarbonate | 30 | THF |
| Ex. 49 | 980HOA | 30 | Zinc Antimonate | 50 | Polycarbonate | 20 | THF |
| Ex. 50 | 980HOA | 40 | ITO | 30 | Alkyd/Melamine (1/1) | 30 | MEK |
| Comp. Ex. 14 | — | 0 | ITO | 50 | Alkyd/Melamine (1/1) | 50 | MEK |
| Comp. Ex. 15 | 980HOA | 50 | — | 0 | Epoxy | 50 | MEK |
| Comp. Ex. 16 | 980HOA | 10 | — | 0 | Polycarbonate | 90 | THF |
| Comp. Ex. 17 | 980HOA | 90 | — | 0 | Alkyd/Melamine (1/1) | 10 | MEK |
| Comp. Ex. 18 | 980HOA | 50 | ITO | 50 | — | 0 | — |
| Comp. Ex. 19 | — | 0 | — | 0 | Alkyd/Melamine (1/1) | 100 | MEK |
| Ex. 51 | 980HOA | 8 | ITO | 3 | Polycarbonate | 17 | THF |

* In Table 7, "980HOA" is a β-form zeolite 980 HOA from Tosoh Corporation, "ITO" is SUFP from Sumitomo Metal Mining Co., Ltd., "Tin Oxide" is S2000 from Mitsubishi Materials Corporation, "Activated Carbon" is RP-20 from Kuraray Chemical Co., Ltd., "Zinc Antimonate" is CELNAX CX-Z210IP from Nissan Chemical Industries, Ltd., "Epoxy" is 827 from Japan Epoxy Resins Co., Ltd., "Alkyd" is BECKOSOL 1307-60-EL from DIC Corporation, "Melamine" is SUPER BECKAMINE G-821-60 from DIC Corporation, and "Polycarbonate" is IUPILON Z300 fromMitsubishi Gas Chemical Company, Inc.

TABLE 8-continued

| | Evaluation | Evaluation (5) | | Evaluation (6) | |
|---|---|---|---|---|---|
| | (4) Volume Resistance (Ω) | Surface Potential of Photoreceptor (−V) | Raindrop-like mark | Difference in Surface Potential (−V) | Image Density Un-evenness |
| Ex. 42 | $1.2 \times 10^{9}$ | 820 | B | 10 | A |
| Ex. 43 | $7.5 \times 10^{8}$ | 805 | B | 15 | A |
| Ex. 44 | $9.2 \times 10^{7}$ | 800 | B | 20 | B |
| Ex. 45 | $8.8 \times 10^{9}$ | 870 | B | 5 | A |
| Ex. 46 | $1.0 \times 10^{10}$ | 890 | B | 5 | A |
| Ex. 47 | $7.8 \times 10$ | 790 | A | 25 | B |
| Ex. 48 | $8.5 \times 10^{6}$ | 780 | A | 15 | A |
| Ex. 49 | $3.3 \times 10^{7}$ | 785 | A | 20 | B |
| Ex. 50 | $9.1 \times 10^{9}$ | 880 | B | 20 | B |
| Comp. Ex. 14 | $9.0 \times 10^{7}$ | 795 | B | 70 | D |
| Comp. Ex. 15 | $1.5 \times 10^{11}$ | 1050 | D | 40 | D |
| Comp. Ex. 16 | $3.4 \times 10^{10}$ | 980 | D | 60 | D |

TABLE 8-continued

| | Evaluation | Evaluation (5) | | Evaluation (6) | |
|---|---|---|---|---|---|
| | (4) Volume Resistance (Ω) | Surface Potential of Photoreceptor (−V) | Raindrop-like mark | Difference in Surface Potential (−V) | Image Density Un-evenness |
| Comp. Ex. 17 | $1.9 \times 10^{12}$ | 1120 | D | 10 | A |
| Comp. Ex. 18 | Avaluative | — | — | — | — |
| Comp. Ex. 19 | $2.0 \times 10^{10}$ | 950 | D | 75 | D |
| Ex. 51 | $1.1 \times 10^{11}$ | 1000 | D | 15 | A |

It is apparent from Table 8 that images are reliably produced when the volume resistance of the coating layer is $1.0\times10^{10}\Omega$ or less.

Examples 52 to 63 and Comparative Examples 20 to 22

The procedure for preparation of the coating layer on the charging grid in Example 1 was repeated except that the composition of the coating liquid was changed to those shown in Table 9.

The resultant corona charger was subjected to the above-described evaluations (1) to (3) using the above-prepared photoreceptor (2).

TABLE 9

| | Composition of Coating Liquid | | | | | | |
|---|---|---|---|---|---|---|---|
| | | Conductive | Binder Resins: c | | Weight Ratio | | |
| | Zeolite: a | Agent: b | c1 | c2 | a/b/c | c1/c2 | Solvent |
| Ex. 52 | 980HOA | Zinc Antimonate | Oil-free Alkyd | Melamine | 5/3/2 | 3/2 | 2-Butanone |
| Ex. 53 | 980HOA | Zinc Antimonate | Oil-modified Alkyd | Melamine | 5/3/2 | 3/2 | 2-Butanone |
| Ex. 54 | 980HOA | Zinc Antimonate | Epoxy-modified Alkyd | Melamine | 5/3/2 | 3/2 | 2-Butanone |
| Ex. 55 | 980HOA | Zinc Antimonate | Oil-free Alkyd | Guanamine | 5/3/2 | 3/2 | 2-Butanone |
| Ex. 56 | 980HOA | Zinc Antimonate | Oil-free Alkyd | Melamine | 5/3/2 | 1/1 | 2-Butanone |
| Ex. 57 | 980HOA | Zinc Antimonate | Oil-free Alkyd | Melamine | 5/3/2 | 4/1 | 2-Butanone |
| Ex. 58 | 980HOA | Zinc Antimonate | Oil-free Alkyd | Melamine | 6/3/1 | 3/2 | 2-Butanone |
| Ex. 59 | 980HOA | Zinc Antimonate | Oil-free Alkyd | Melamine | 2.5/1.5/6 | 3/2 | 2-Butanone |
| Comp. Ex. 20 | — | — | — | — | — | — | — |
| Comp. Ex. 21 | 980HOA | — | Oil-free Alkyd | Melamine | 8/0/2 | 3/2 | 2-Butanone |
| Ex. 60 | 980HOA | Zinc Antimonate | Polyvinyl Butyral | — | 5/3/2 | — | 2-Butanone |
| Comp. Ex. 22 | — | Zinc Antimonate | Polyvinyl Butyral | — | 0/6/4 | — | 2-Butanone |
| Ex. 61 | 980HOA | Zinc Antimonate | Polyurethane | — | 5/3/2 | — | 2-Butanone |
| Ex. 62 | 980HOA | Zinc Antimonate | Perfluorocarbon Sulfonic Acid Resin | — | 5/3/2 | — | Methanol/Butanol (7/3) |

TABLE 9-continued

| | Composition of Coating Liquid | | | | | | |
|---|---|---|---|---|---|---|---|
| | | Conductive | Binder Resins: c | | Weight Ratio | | |
| | Zeolite: a | Agent: b | c1 | c2 | a/b/c | c1/c2 | Solvent |
| Ex. 63 | 980HOA | Zinc Antimonate | Bisphenol A type Polycarbonate | — | 5/3/2 | — | THF |

* In Table 9, "980HOA" is a β-form zeolite 980 HOA from Tosoh Corporation, "Zinc Antimonate" is CELNAX CX-Z210IP from Nissan Chemical Industries, Ltd., "Oil-free Alkyd" is BECKOLITE 46-118 from DIC Corporation, "Melamine" is SUPER BECKAMINE G-821-60 from DIC Corporation, "Oil-modified Alkyd" is BECKOZOL EZ-3801-60 from DIC Corporation, "Epoxy-modified Alkyd" is BECKOSOL P-790-50 from DIC Corporation, "Guanamine" is SUPER BECKAMINE TD-126 from DIC Corporation, "Polyvinyl Butyral" is S-LEC BX-1 from Sekisui Chemical Co., Ltd., "Polyurethane" is NIPPOLAN 5196 from Nippon Polyurethane Industry Co., Ltd., "Perfluorocarbon Sulfonic Acid Resin" is NAFION ® 52721-1 from DuPont), and "Bisphenol A type Polycarbonate" is IUPILON Z300 from Mitsubishi Gas Chemical Company, Inc.

The evaluation results of Examples 52 to 63 and Comparative Examples 20 to 22 are shown in Tables 10-1, 10-2, and 10-3.

TABLE 10-1

| | Evaluation (1) | |
|---|---|---|
| | Initial Stage | After 200-hour Discharge |
| Ex. 52 | A | A |
| Ex. 53 | A | B |
| Ex. 54 | A | B |
| Ex. 55 | A | A |
| Ex. 56 | A | B |
| Ex. 57 | A | B |
| Ex. 58 | A | C |
| Ex. 59 | A | A |
| Comp. Ex. 20 | — | — |
| Comp. Ex. 21 | A | A |
| Ex. 60 | B | D |
| Comp. Ex. 22 | A | A |
| Ex. 61 | B | D |
| Ex. 62 | C | D |
| Ex. 63 | C | D |

It is apparent from Table 10-1 that when the coating layer includes a binder resin including both an alkyd resin and an amino resin, the coating layer reliably adheres to the charging grid for an extended period of time. In particular, when the content of the binder resin is from 10 to 60% by weight, the coating layer is more intimately adhered to the charging grid, the photoreceptor is more reliably charged, and discharge products are more sufficiently removed.

TABLE 10-2

| | Evaluation (2) | | |
|---|---|---|---|
| | Surface Potential of | Raindrop-like Marks | |
| | Photoreceptor (−V) | Initial Stage | After 200-hour Discharge |
| Ex. 52 | 800 | A | A |
| Ex. 53 | 790 | A | A |
| Ex. 54 | 800 | A | A |
| Ex. 55 | 810 | A | A |
| Ex. 56 | 800 | A | A |
| Ex. 57 | 810 | A | A |
| Ex. 58 | 800 | A | A |
| Ex. 59 | 840 | A | B |
| Comp. Ex. 20 | 800 | A | A |
| Comp. Ex. 21 | 1040 | D | D |
| Ex. 60 | 790 | A | A |
| Comp. Ex. 22 | 800 | A | A |
| Ex. 61 | 810 | A | A |
| Ex. 62 | 800 | A | A |
| Ex. 63 | 800 | A | A |

It is apparent from Table 10-2 that the surface potential of the photoreceptor excesses the voltage applied to the charging grid and the resultant image is uneven when the coating layer include no conductive agent. In other words, the photoreceptor is not reliably charged when the coating layer include no conductive agent. By contrast, when the coating layer includes a conductive agent, the surface potential of the photoreceptor is similar to that in a case the coating layer is not formed on the charging grid. In other words, the photoreceptor is reliably charged when the coating layer includes a conductive agent.

TABLE 10-3

| | Evaluation (3) | | |
|---|---|---|---|
| | Image Density Unevenness | | |
| | Initial Stage | After 200-hour Discharge | Image Blurring |
| Ex. 52 | A | A | A |
| Ex. 53 | A | A | A |
| Ex. 54 | A | A | A |
| Ex. 55 | A | A | A |
| Ex. 56 | A | A | A |
| Ex. 57 | A | A | A |
| Ex. 58 | A | A | A |
| Ex. 59 | A | B | B |
| Comp. Ex. 20 | D | D | D |
| Comp. Ex. 21 | A | A | A |
| Ex. 60 | A | D | D |
| Comp. Ex. 22 | D | D | D |
| Ex. 61 | A | D | D |
| Ex. 62 | B | D | D |
| Ex. 63 | B | D | D |

It is apparent from Table 10-3 that corona chargers including a charging grid having a coating layer including a zeolite are capable of suppressing production of NOx, effectively removing discharge products, and suppressing the occurrence of image density unevenness and image blurring.

Examples 64 to 75 and Comparative Examples 23 to 25

The procedure for preparation of the coating layer on the charging grid in Example 1 was repeated except that the composition of the coating liquid was changed to those shown in Table 11.

The resultant corona charger was subjected to the above-described evaluations (1) to (3) using the above-prepared photoreceptor (2).

TABLE 11

| | Composition of Coating Liquid | | | | | |
|---|---|---|---|---|---|---|
| | Zeolite: a | Conductive Agent: b | Binder Resin: c | Acid Catalyst: d | Weight Ratio (a/b/c/d) | Solvent |
| Ex. 64 | 980HOA | Zinc Antimonate | Copolymerized Polyamide 1 | | 5/3/2/0 | Methanol/Butanol (7/3) |
| Ex. 65 | A-3 | Zinc Antimonate | Modified Polyamide 1 | L-Tartaric Acid | 5/3/2/0.05 | Methanol/Butanol (7/3) |
| Ex. 66 | 980HOA | Zinc Antimonate | Modified Polyamide 1 | | 5/3/2/0 | Methanol/Butanol (7/3) |
| Ex. 67 | 980HOA | Zinc Antimonate | Copolymerized Polyamide 2 | | 5/3/2/0 | Methanol/Butanol (7/3) |
| Ex. 68 | A-3 | Zinc Antimonate | Modified Polyamide 2 | Citric Acid | 5/3/2/0.05 | Methanol/Butanol (7/3) |
| Ex. 69 | 980HOA | Zinc Antimonate | Modified Polyamide 2 | | 5/3/2/0 | Methanol/Butanol (7/3) |
| Ex. 70 | 980HOA | Zinc Antimonate | Copolymerized Polyamide 1 | | 6/3/1/0 | Methanol/Butanol (7/3) |
| Ex. 71 | 980HOA | Zinc Antimonate | Copolymerized Polyamide 1 | | 2.5/1.5/6/0 | Methanol/Butanol (7/3) |
| Comp. Ex. 23 | — | — | — | | — | |
| Comp. Ex. 24 | 980HOA | — | Copolymerized Polyamide 1 | | 8/0/2/0 | Methanol/Butanol (7/3) |
| Ex. 72 | 980HOA | Zinc Antimonate | Polyvinyl Butyral | | 5/3/2/0 | Methanol/Butanol (7/3) |
| Comp. Ex. 25 | — | Zinc Antimonate | Copolymerized Polyamide 1 | | 0/6/4/0 | Methanol/Butanol (7/3) |
| Ex. 73 | 980HOA | Zinc Antimonate | Polyurethane | | 5/3/2/0 | Methanol/Butanol (7/3) |
| Ex. 74 | 980HOA | Zinc Antimonate | Perfluorocarbon Sulfonic Acid Resin | | 5/3/2/0 | Methanol/Butanol (7/3) |
| Ex. 75 | 980HOA | Zinc Antimonate | Bisphenol Z type Polycarbonate | | 5/3/2/0 | THF |

* In Table 11, "980HOA" is a β-form zeolite 980 HOA from Tosoh Corporation, "A-3" is a potassium-ion-containing A-form zeolite A-3 from Tosoh Corporation, "Zinc Antimonate" is CELNAX CX-Z210IP from Nissan Chemical Industries, Ltd., "Copolymerized Polyamide 1" is CM-8000 from Toray Industries, Inc., "Copolymerized Polyamide 2" is CM-4000 from Toray Industries, Inc., "Modified Polyamide 1" is a methoxymethylated polyamide FR-101 from Namariichi Co., Ltd., "Modified Polyamide 2" is a methoxymethylated polyamide F30K from Nagase ChemteX Corporation, "Polyvinyl Butyral" is S-LEC BX-1 from Sekisui Chemical Co., Ltd., "Polyurethane" is NIPPOLAN 5196 from Nippon Polyurethane Industry Co., Ltd., "Perfluorocarbon Sulfonic Acid Resin" is NAFION ® 52721-1 from DuPont), and "Bisphenol A type Polycarbonate" is IUPILON Z300 from Mitsubishi Gas Chemical Company, Inc.

The evaluation results of Examples 64 to 74 and Comparative Examples 23 to 25 are shown in Tables 12-1, 12-2, and 12-3.

TABLE 12-1

| | Evaluation (1) | |
|---|---|---|
| | Initial Stage | After 200-hour Discharge |
| Ex. 64 | A | A |
| Ex. 65 | A | A |
| Ex. 66 | A | B |
| Ex. 67 | A | A |
| Ex. 68 | A | A |
| Ex. 69 | A | B |
| Ex. 70 | A | B |
| Ex. 71 | A | A |
| Comp. Ex. 23 | — | — |
| Comp. Ex. 24 | A | A |
| Ex. 72 | B | D |
| Comp. Ex. 25 | A | A |
| Ex. 73 | B | D |
| Ex. 74 | C | D |
| Ex. 75 | C | D |

It is apparent from Table 12-1 that when the coating layer includes a binder resin including a polyamide resin, the coating layer reliably adheres to the charging grid for an extended period of time. In particular, when the content of the binder resin is from 10 to 60% by weight, the coating layer is more intimately adhered to the charging grid, the photoreceptor is more reliably charged, and discharge products are more sufficiently removed.

TABLE 12-2

| | Evaluation (2) | | |
|---|---|---|---|
| | Surface Potential of Photoreceptor (−V) | Raindrop-like Marks | |
| | | Initial Stage | After 200-hour Discharge |
| Ex. 64 | 810 | A | A |
| Ex. 65 | 790 | A | A |
| Ex. 66 | 790 | A | A |
| Ex. 67 | 800 | A | A |
| Ex. 68 | 810 | A | A |
| Ex. 69 | 810 | A | A |
| Ex. 70 | 800 | A | A |
| Ex. 71 | 840 | A | B |
| Comp. Ex. 23 | 800 | A | A |
| Comp. Ex. 24 | 1040 | D | D |
| Ex. 72 | 790 | A | A |
| Comp. Ex. 25 | 800 | A | A |
| Ex. 73 | 810 | A | A |
| Ex. 74 | 800 | A | A |
| Ex. 75 | 800 | A | A |

It is apparent from Table 12-2 that the surface potential of the photoreceptor excesses the voltage applied to the charging grid and the resultant image is uneven when the coating layer include no conductive agent. In other words, the photoreceptor is not reliably charged when the coating layer include no conductive agent. By contrast, when the coating layer includes a conductive agent, the surface potential of the photoreceptor is similar to that in a case the coating layer is not formed on the charging grid. In other words, the photoreceptor is reliably charged when the coating layer includes a conductive agent.

TABLE 12-3

| | Evaluation (3) | | |
|---|---|---|---|
| | Image Density Unevenness | | |
| | Initial Stage | After 200-hour Discharge | Image Blurring |
| Ex. 64 | A | A | A |
| Ex. 65 | A | A | A |
| Ex. 66 | A | A | A |
| Ex. 67 | A | A | A |
| Ex. 68 | A | A | A |
| Ex. 69 | A | A | A |
| Ex. 70 | A | A | A |
| Ex. 71 | A | B | B |
| Comp. Ex. 23 | D | D | D |
| Comp. Ex. 24 | A | A | A |
| Ex. 72 | A | D | D |
| Comp. Ex. 25 | D | D | D |
| Ex. 73 | A | D | D |
| Ex. 74 | B | D | D |
| Ex. 75 | B | D | D |

It is apparent from Table 12-3 that corona chargers including a charging grid having a coating layer including a zeolite are capable of suppressing production of NOx, effectively removing discharge products, and suppressing the occurrence of image density unevenness and image blurring.

Additional modifications and variations of the present invention are possible in light of the above teachings. It is therefore to be understood that within the scope of the appended claims the invention may be practiced other than as specifically described herein.

This document claims priority from and contains subject matter related to Japanese Patent Application Nos. 2007-318183, 2007-318218, 2007-318197, 2007-335770, and 2008-179754, filed on Dec. 10, 2007, Dec. 10, 2007, Dec. 10, 2007, Dec. 27, 2007, and Jul. 10, 2008, respectively, the entire contents of each of which are herein incorporated by reference.

What is claimed is:

1. A corona charger, comprising:
a corona discharge electrode; and
a control electrode,
wherein a layer comprising a zeolite, a conductive agent, and a binder resin is formed on a surface of the control electrode.

2. The corona charger according to claim 1, wherein the zeolite has a crystal form selected from the group consisting of A-form, X-form, and Y-form.

3. The corona charger according to claim 2, wherein the zeolite contains a cationic species selected from the group consisting of potassium, sodium, calcium, and hydrogen.

4. The corona charger according to claim 1, wherein the layer has a volume resistance of $1.0\times10^{10}\Omega$ or less.

5. The corona charger according to claim 1, wherein the conductive agent is a metal oxide.

6. The corona charger according to claim 5, wherein the metal oxide is a zinc antimonate.

7. The corona charger according to claim 1, wherein the binder resin is a polyamide resin.

8. The corona charger according to claim 1, wherein the binder resin is a hardened resin.

9. The corona charger according to claim 8, wherein the hardened resin is a composition of an alkyd resin and an amino resin.

10. The corona charger according to claim 9, wherein the alkyd resin is an oil-free alkyd resin.

11. The corona charger according to claim 9, wherein the amino resin is selected from the group consisting of a melamine resin and a guanamine resin.

12. The corona charger according to claim 9, wherein the composition comprises the amino resin in an amount of from 25 to 100 parts by weight based on 100 parts by weight of the alkyd resin.

13. The corona charger according to claim 1, wherein the layer comprises the zeolite in an amount of from 20 to 50% by weight based on a total weight of the zeolite, the conductive agent, and the binder resin.

14. The corona charger according to claim 1, wherein the surface layer comprises the conductive agent in an amount of from 20 to 50% by weight based on a total weight of the zeolite, the conductive agent, and the binder resin.

15. The corona charger according to claim 1, wherein the surface layer comprises the binder resin in an amount of from 10 to 60% by weight based on a total weight of the zeolite, the conductive agent, and the binder resin.

16. A process cartridge, detachably attachable to an image forming apparatus, comprising:
a photoreceptor; and
a corona charger comprising:
a corona discharge electrode; and
a control electrode,
wherein a layer comprising a zeolite, a conductive agent, and a binder resin is formed on a surface of the control electrode.

17. An image forming apparatus, comprising:
a photoreceptor configured to bear an electrostatic latent image;
a charger configured to charge a surface of the photoreceptor:
an irradiating device configured to irradiate the charged surface of the photoreceptor to form an electrostatic latent image thereon;
a developing device configured to develop the electrostatic latent image with a toner to form a toner image;
a transfer device configured to transfer the toner image onto a recording medium; and
a fixing device configured to fix the toner image on the recording medium,
wherein the charger is a corona charger comprising:
a corona discharge electrode; and
a control electrode,
wherein a layer comprising a zeolite, a conductive agent, and a binder resin is formed on a surface of the control electrode.

18. The image forming apparatus according to claim 17, wherein the photoreceptor comprises a cross-linked surface layer.

19. The image forming apparatus according to claim 17, wherein the photoreceptor comprises a non-cross-linked charge transport layer serving as an outermost layer.

* * * * *